US005475484A

United States Patent [19]

Kimura

[11] Patent Number: 5,475,484

[45] Date of Patent: Dec. 12, 1995

[54] IMAGE FORMING APPARATUS

[75] Inventor: Kazuhisa Kimura, Hiratsuka, Japan

[73] Assignee: Kabushiki Kaisha Toshiba, Kanagawa, Japan

[21] Appl. No.: 248,450

[22] Filed: May 24, 1994

[30] Foreign Application Priority Data

May 26, 1993 [JP] Japan ..... 5-124445

[51] Int. Cl.[6] ..... G03G 15/01

[52] U.S. Cl. ..... 355/326 R; 355/210; 355/327

[58] Field of Search ..... 355/326 R, 327, 355/210, 200, 271, 228, 211, 328; 346/157, 160.1; 347/112, 115, 117–118, 138, 152, 153, 154

[56] References Cited

U.S. PATENT DOCUMENTS

| | | | |
|---|---|---|---|
| 4,530,588 | 7/1985 | Kimura et al. | 355/211 |
| 5,132,728 | 7/1992 | Suzaki et al. | 355/200 |
| 5,212,520 | 5/1993 | Toyofuku | 355/200 |

FOREIGN PATENT DOCUMENTS

| | | | |
|---|---|---|---|
| 62-229264 | 10/1987 | Japan . | |
| 0299927 | 12/1987 | Japan | 355/327 A |
| 63-43173 | 2/1988 | Japan | 355/327 A |
| 0253979 | 10/1988 | Japan | 355/211 |
| 63-301065 | 12/1988 | Japan | 355/327 A |
| 0021466 | 1/1989 | Japan | 355/210 |
| 0112261 | 4/1989 | Japan | 355/211 |

*Primary Examiner*—Matthew S. Smith
*Attorney, Agent, or Firm*—Limbach & Limbach

[57] ABSTRACT

A color printer comprises first and second photo-conductive drums which are supported between first and second supporting plates substantially in parallel to each other. Rotational shafts of the drums are attached to the first supporting plates through first and second supporting members and to the second supporting plates through a third and fourth supporting members. The first supporting member has a first driving force transmission shaft for rotating a rotational shaft of the first drum, and a first pivot bearing member rotatably supporting the first driving force transmission shaft. The second supporting member has a second driving force transmission shaft for rotating a rotational shaft of the second drum, and a second pivot bearing member rotatably supporting the second driving force transmission shaft. The third supporting member has a third pivot bearing member rotatably supporting the rotational shaft of the first drum. The fourth supporting member has a fourth pivot bearing member rotatably supporting the rotational shaft of the second drum. The first and second transmission shafts have distal ends which are engageable with the third and fourth pivot bearing members, respectively.

13 Claims, 19 Drawing Sheets

IMAGE FORMING APPARATUS

BACKGROUND OF THE INVENTION

1. Field of the Invention

The present invention relates to an image forming apparatus in which toner images are formed on a plurality of image carrying bodies and successively transferred to a transfer material such as paper, thereby forming a multicolor image.

2. Description of the Related Art

In recent years, color copying machines have been put into practical use to meet a demand for colored documents in the office. A copying machine having four serial photosensitive drums is known as one of the color copying machines. In this type of copying machine, four photoconductive drums are arranged in parallel with one another, and four toner images are individually formed on the drums with yellow, magenta, cyan and black toners, and consecutively transferred to a transfer material.

Thus, in the four-drum copying machine, since toner images individually formed on the four drums are consecutively transferred to a transfer material, a plurality of image forming sections respectively including the photoconductive drums must be arranged in parallel with each other. If the image forming sections are not parallel with a satisfactory accuracy, the obtained color image will have color deviation.

To prevent this, in a conventional color copying machine, as disclosed in Jpn. Pat. Appln. KOKAI Publication No. 64-84263, one axial end portion of each of the image forming sections is attached to a fixed position on a body frame located on the rear side of the copying machine main body, while the other axial end portion thereof is fixed to a body frame located on the front side of the main body via a position-adjustable supporting member. Upon assembling the copying machine, the plurality of image forming sections are provisionally attached to the body frames, and in this state, the copying machine is operated to actually form a color image. The degree of parallelism of the image forming sections is adjusted by changing the positions of the supporting members, while the state of color deviation is being observed. After the adjustment is completed, the supporting members are immovably fixed to the body frames. Thus, the assembly of the image forming sections is finished.

As described above, the conventional color copying machine is disadvantageous in that the assembly is difficult and very time-consuming, since a plurality of image forming sections must be fixed to body frames, while the positions thereof being individually adjusted.

SUMMARY OF THE INVENTION

The present invention has been made in consideration of the above situations and its object is to provide an image forming apparatus which can be assembled easily and efficiently and can provide a satisfactory color image without color deviation.

To achieve the above object, the image forming apparatus comprises: first image forming means for forming an image of a first color on a first image carrier having a first rotational shaft second image forming means for forming an image of a second color on a second image carrier having a second rotational shaft; first and second supporting plates for supporting the first and second rotating shafts substantially in parallel to each other; first and second supporting members attaching the first and second rotational shafts to the first supporting plate; and third and fourth supporting members attaching the first and second rotational shafts to the second supporting plate.

The first supporting member includes a first driving force transmission shaft for rotating the first rotational shaft, a first pivot bearing member for rotatably supporting the first driving force transmission shaft, and a first fixing portion for fixing the first supporting member to the first supporting plate. The second supporting member includes a second driving force transmission shaft for rotating the second rotational shaft, a second pivot bearing member for rotatably supporting the second driving force transmission shaft, and a first fixing portion for fixing the first supporting member to the first supporting plate. The third supporting member includes a third pivot bearing member for rotatably supporting the first rotational shaft of the first image carrier, and a third fixing portion for fixing the third supporting member to the second supporting plate. The fourth supporting member includes a fourth pivot bearing member for rotatably supporting the second rotational shaft of the second image carrier, and a fourth fixing portion for fixing the fourth supporting member to the second supporting plate.

The first driving force transmission shaft has an axial end engageable with the third pivot bearing member, and the second driving force transmission shaft has an axial end engageable with the fourth pivot bearing member.

In the above image forming apparatus, each of the third and fourth supporting member includes the third and fourth pivot bearing members which can be engaged with the first and second transmission shafts, respectively. Therefore, before the second supporting plate, to which the third and fourth supporting members are attached, is fixed to the main body frame, the third and fourth pivot bearing members are engaged with the corresponding transmission shafts of the first and second supporting members, resulting in that the third and fourth supporting members are accurately positioned and aligned with the first and second supporting members, respectively. Thereafter, the second supporting plate, to which the accurately positioned third and fourth supporting members are attached, is fixed to the body frame. Thus, since the third and fourth supporting members are positioned with respect to the second supporting plate in advance, the third and fourth supporting members need not be position-adjusted after attached to the body frame. Therefore, the efficiency of assembling the apparatus can be greatly improved. In addition, the first and second image carriers can be held in parallel with a high accuracy. As a result, a satisfactory image without color deviation can be formed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

FIGS. 1 to 25 shows a color printer according to an embodiment of the present invention, in which:

FIG. 1 is a cross-sectional view of the entire structure of the printer;

FIG. 2 is a perspective view showing an assembled state of an essential part of the printer;

FIG. 3 is a perspective view showing a state in which drum units are attached to body frames;

FIG. 4 is a cross-sectional view showing the state in which the drum units are attached to the body frames;

FIG. 5 is a cross-sectional view showing a supporting mechanism for a first axial end portion of a photoconductive drum;

FIG. 6 is a cross-sectional view showing a supporting mechanism for a second axial end portion of the photoconductive drum;

FIG. 7 is a cross-sectional view showing first and second supporting plates to which first and second supporting portions are attached;

FIG. 8 is a cross-sectional view showing a state in which the first and second supporting plates are placed opposite to each other such that the first supporting portions are respectively aligned with the second supporting portions;

FIG. 9 is a perspective view showing a state in which the first supporting plate is to be attached to a first body frame;

FIG. 10 is a perspective view showing a state in which the drum units and the second supporting plate are to be attached to the body frames;

FIG. 11 is a perspective view showing a state in which exposing devices are assembled in the body frames;

FIG. 12 is a cross-sectional view showing the state in which the exposing devices are assembled in the body frames;

FIG. 13 is a partially cut-out side view showing the exposing device and first and second supporting mechanisms;

FIG. 14 is a cross-sectional view showing a state in which the exposure device is fixed to the first and second supporting plates;

FIG. 15 is a cross-sectional view showing first and second supporting plates to which first and second supporting portions are attached;

FIG. 16 is a cross-sectional view showing a state in which the first and second supporting plates are placed opposite to each other, such that the first supporting portions are respectively aligned with the second supporting portions;

FIG. 17 is a perspective view showing a state in which the exposing devices fixed to the first and second supporting plates are to be attached to the body frames;

FIG. 18 is a perspective view showing a state in which a transfer unit is attached to the body frames;

FIG. 19 is a cross-sectional view showing a right half of the transfer unit attached to the body frames;

FIG. 20 is a cross-sectional view showing a left half of the transfer unit attached to the body frames;

FIG. 21 is a cross-sectional view showing a right half of the first and second supporting plates to which the first and second supporting portions are attached;

FIG. 22 is a cross-sectional view showing a left half of the first and second supporting plates to which the first and second supporting portions are attached;

FIG. 23 is a cross-sectional view showing a right half of the first and second supporting plates in a state where they are placed opposite to each other, such that the first supporting portions are respectively aligned with the second supporting portions;

FIG. 24 is a cross-sectional view showing a left half of the first and second supporting plates in a state where they are placed opposite to each other, such that the first supporting portions are respectively aligned with the second supporting portions; and FIG. 25 is a perspective view showing a state in which the transfer unit is to be attached to the body frames.

DETAILED DESCRIPTION OF THE PREFERRED EMBODIMENT

An embodiment, in which the present invention is applied to a color printer, will be described in detail with reference to the accompanying drawings.

Figure 1:
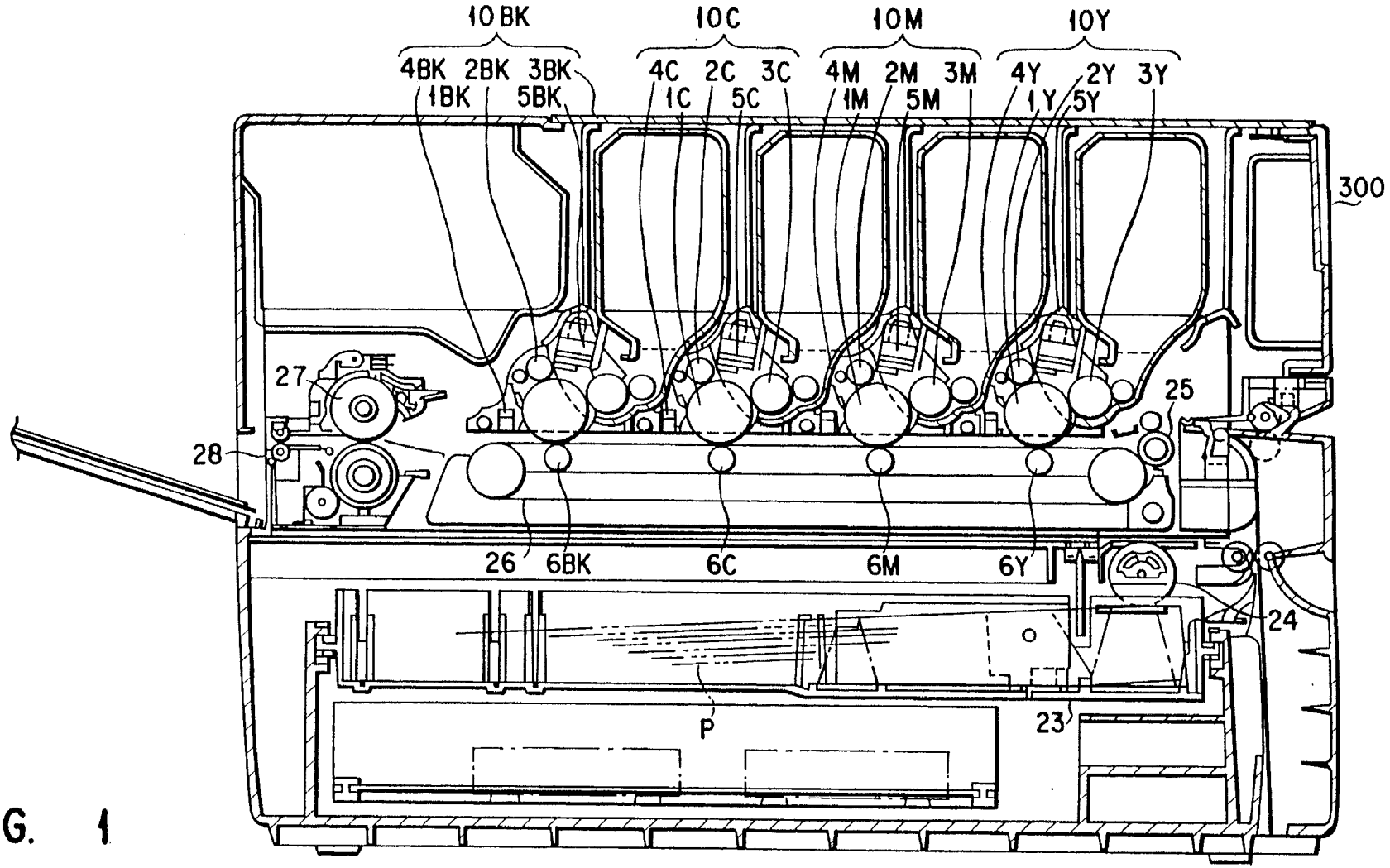

As shown in FIG. 1, four recording devices 10Y, 10M, 10C and 10BK, serving as image forming means for forming images with yellow, magenta, cyan and black toners, are arranged in series in a housing 300 of the color printer.

The recording devices 10Y, 10M, 10C and 10BK are respectively provided with the same components. Therefore, to make the following description simple, only the cyan recording device 10C will be described and detailed explanations of the other recording devices 10Y, 10M and 10BK will be omitted. The same components of the respective recording devices are identified with the same reference numerals and the letters Y, M, C and BK representing the colors are added to the reference numerals to distinguish a component of the recording device for one color from that of the other color recording devices.

The recording device 10C comprises a photoconductive drum 10C or an image carrier. It also comprises a charging device 2C or charging means, an exposing device 5C or a solid scanning head, a developing device 3C or developing means, a transfer roller 6C or transfer means, and a cleaning device 4C or cleaning means, all of which are provided around the photoconductive drum 1C. A cyan latent image is formed by means of the exposure of the exposing device 5C on the photoconductive drum 1C which is uniformly charged by the charging device 2C. The latent image is developed by the developing device 3C into a visible image (toner image).

A recording paper sheet P serving as transfer material is supplied from a paper cassette 23 to feeding rollers 24. The leading end of the paper sheet P is aligned by a pair of resist rollers 25 and transported to a carrying belt 26 or transfer material carrying means at image forming timing. The paper sheet P is transferred by the carrying belt 26, successively to the photoconductive drums 1Y, 1M, 1C and 1BK of the recording devices 10Y, 10M, 10C and 10BK, on which visible images are respectively formed. The toner images are successively transfer to the paper sheet P under the operation of the transfer rollers 6Y, 6M, 6C and 6BK. Thereafter, the toner images are fixed to the paper sheet P by a fixing device 27 and the paper sheet P is discharged onto a discharge tray 29 through a pair of paper discharging rollers. Since the paper sheet P is held on the carrying belt 26 by static electricity, it can be transferred at a speed accurately the same as the carrying belt.

Figure 2:
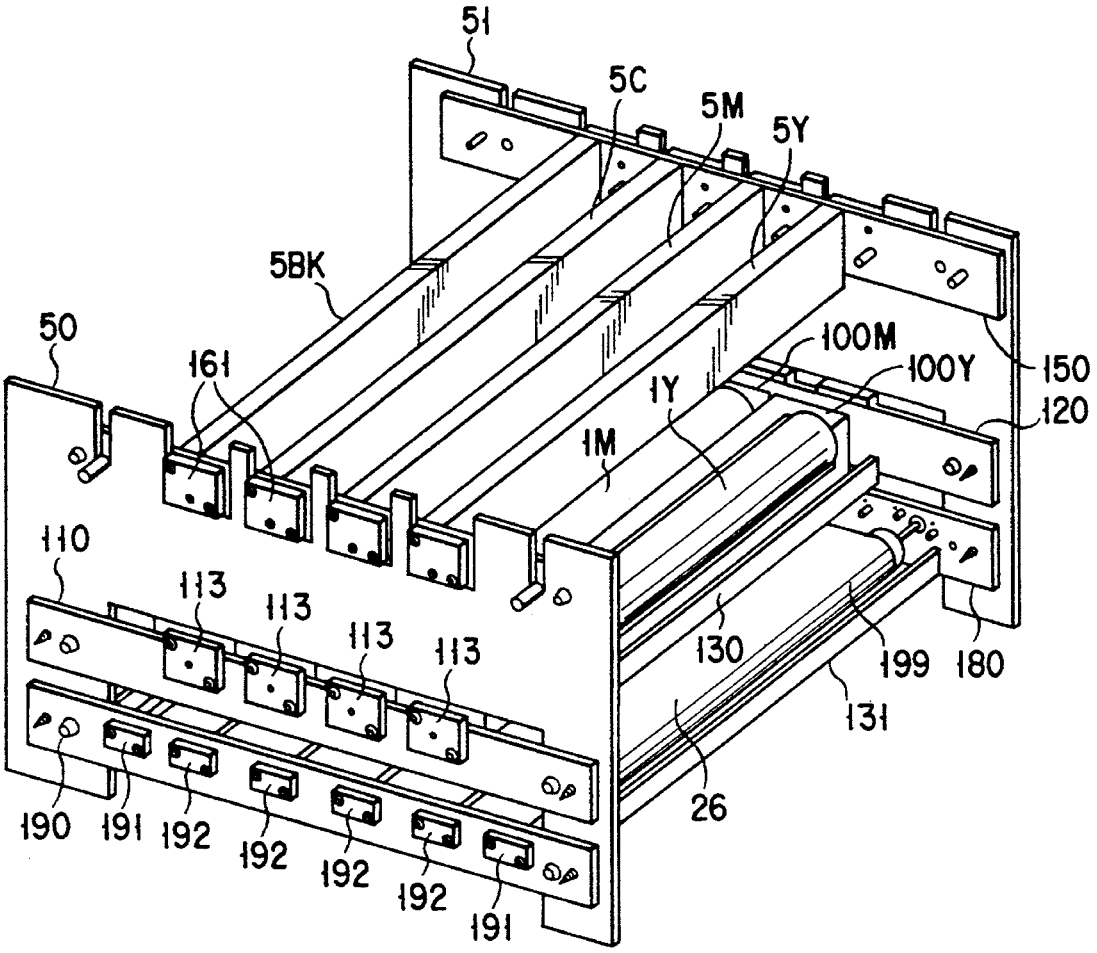

As shown in FIG. 2, in the housing 300, a first body frame 51 on the rear side of the housing and a second body frame 50 on the front side thereof are arranged parallel with each other with a space therebetween. To the first and second body frames 51 and 50 are attached drum units 100Y, 100M, 100C and 100BK including photoconductive drums 1Y, 1M, 1C and 1BK, the exposing devices 5Y, 5M, 5C and 5BK, the transfer material carrying belt 26, and the transfer rollers 6Y, 6M, 6C and 6BK.

First, supporting and attaching mechanisms of the drum unit 100C (100Y, 100M, 100BK), which comprises the photoconductive drum 1C (1Y, 1M, 1BK), the charging device 2C (2Y, 2M, 2BK) and the cleaning device 4C (4Y, 4M, 4BK), will be described.

As shown in FIGS. 3 to 6, the photoconductive drum 1C extends between the first and second body frames 51 and 50. A rotational shaft 54C of the drum 1C includes a first axial end portion 58C located in proximity to the first body frame 51, and a second axial end portion 59C located in proximity to the second body frame 50. A tapered recess 57C is formed in the distal end of the first axial end portion 58C. The second axial end portion 59C has a free end 56C which is tapered in the same shape as the recess 57C. The first and second axial end portions 58C and 59C are respectively supported by the first and second body frames 51 and 50 via first and second supporting mechanisms serving as first and second supporting means.

The first supporting mechanism comprises a first elongated supporting plate 120 fixed to the first body frame 51 and four first supporting portions 121 fixed to the first supporting plate. The first supporting portions 121 are provided for the four colors, and fixed to the first supporting plate 120 at predetermined intervals in the horizontal direction. Each of the first supporting portions 121 comprises a rectangular parallelepiped first supporting member 124, which has a pair of projections 124*a*engaged with holes formed in the first supporting plate 120, and a pair of through holes 124*b*. A pair of screws 30 inserted through the through holes 124*b* are screwed into the first supporting plate 120, thereby fixing the supporting member 124 to a predetermined position on the first supporting plate.

A driving force transmission shaft 122 is rotatably supported by a pivot bearing 123, which is embedded in the first supporting member 124. The transmission shaft 122 has a tapered free end 122*a* projecting from the first supporting plate 120 toward the drum 1C. The free end 122*a* has a shape which can be engaged with the recess 57C of the first axial end portion 58C and is the same as that of the free end 56C of the second axial end portion 59C. The other end of the transmission shaft 122 is connected to a printer driving system (not shown). The free end 122*a* is engaged with the recess 57C formed in the first axial end portion 58C of the photoconductive drum 1C and the drum is rotated by the driving system via the transmission shaft 122.

The second supporting mechanism comprises a second elongated supporting plate 110 fixed to the second body frame 50, and four second supporting portions 113 fixed to the second supporting plate. The second supporting portions 113 are provided for the four colors and fixed to the second supporting plate 110 at predetermined intervals in the horizontal direction, so as to be respectively aligned with the first supporting portions 121. Each of the second supporting portions 113 comprises a rectangular parallelepiped second supporting member 112 and a holding member 111. The holding member 111 holds the second supporting member 112 such that the relative position of the second supporting member and the second supporting plate 110 can be changed. The holding member 111 has a first contact surface 62*a* in contact with the second supporting plate 110 and a second contact surface 62*b* in contact with the second supporting member 112. These surfaces are flat and parallel to the supporting plate 110. The holding member 111 has a pair of projections 63, projecting from the first contact surface 62*a* and engaged with holes formed in the second supporting plate 110, and a pair of recesses 64 formed in the second contact surface 62*b*.

The second supporting member 112 has a contact surface 65 which is in surface-contact with the second contact surface 62*b* of the holding member 111, a pair of projections 66 projecting from the contact surface 65 and loosely fitted with the recesses 64, and a pair of through holes 67. A pair of screws 30 inserted through the through holes 64 are screwed into the second supporting plate 110, thereby fixing the second supporting member 112 to a predetermined position of the second supporting plate. The through hole 64 is sufficiently greater than the shaft portion of the screw 30. Therefore, when the screws 30 are loosened, the supporting member 112 is position-adjustable in parallel with the second supporting plate 110.

A central portion of the second supporting member 112 is inserted, with a gap, in through holes formed in the holding member 111 and the second supporting plate 110, and projects toward the photoconductive drum 1C. A pivot bearing 114 is embedded in the extended end of the central portion of the member 112. The free end 56C of the second axial end portion 59C of the drum 1C is fitted in and rotatably supported by the second pivot bearing 114. Since the free end 122*a* of the transmission shaft 122 of the first supporting mechanism has the same tapered shape as the free end 56C of the second axial end portion 59C as described above, the free end 122*a* of the transmission shaft can be engaged with the second pivot bearing 114 in a step of positioning the second supporting member 112 (to be described later).

Figure 5:
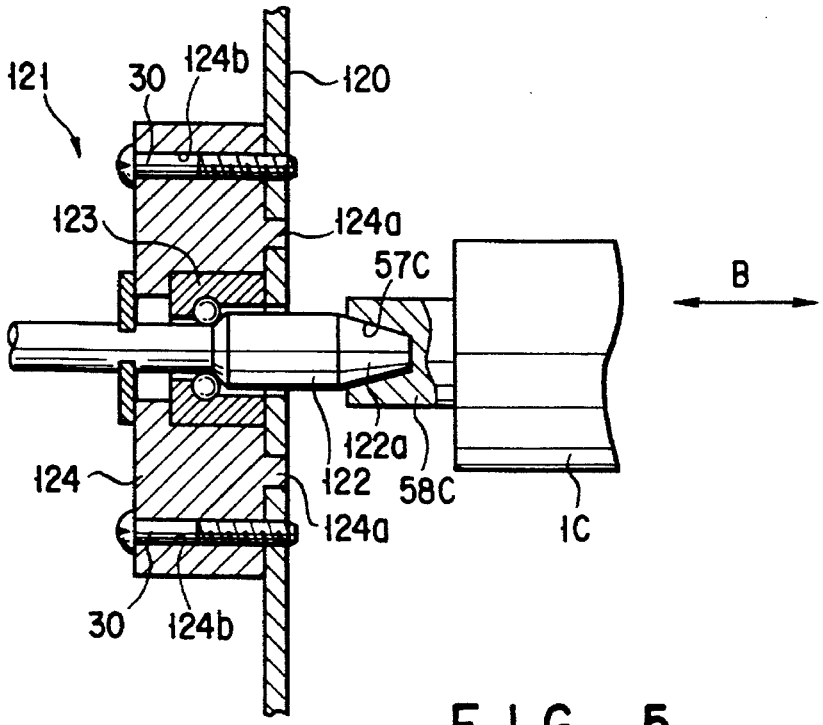
Figure 6:
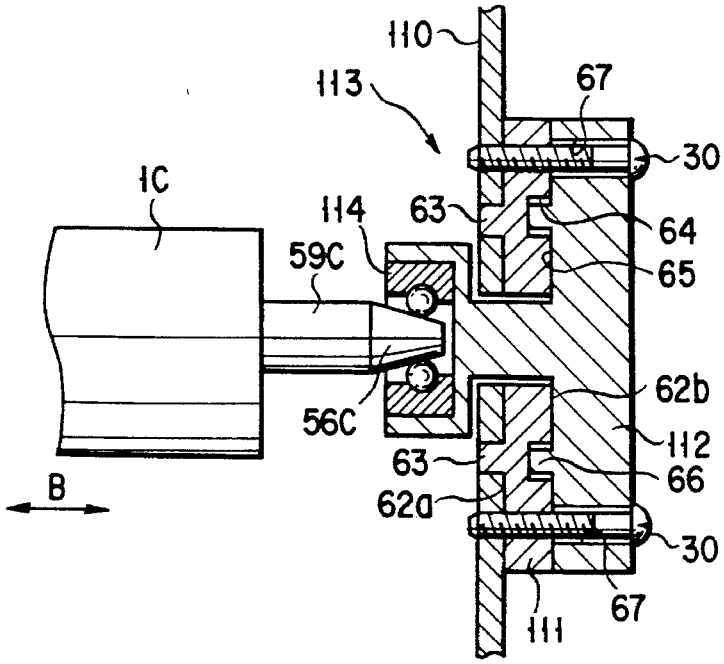
Figure 7:
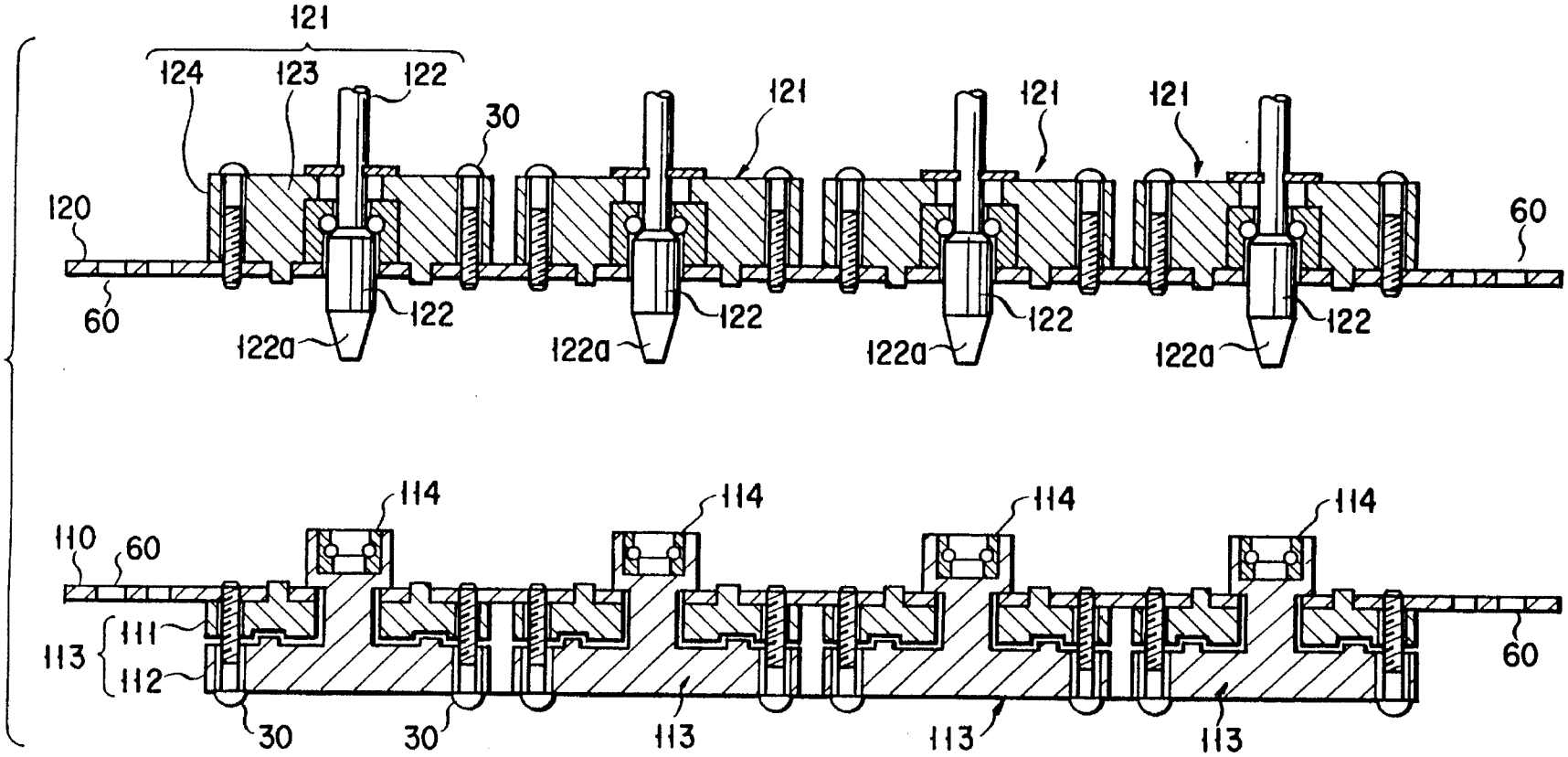

In the manner as described above, the first and second axial end portions 58C and 59C of the photoconductive drum 1C are respectively supported by the transmission shaft 122 and the second pivot bearing 114. As a result, the drum 1C is rotatably supported between the first and second body frames 51 and 50. Since the transmission shaft 122, supporting the first axial end portion 58C of the drum 1C, and the second axial end portion 59C of the drum 1C are respectively supported by the pivot bearings 123 and 114, the drum can be easily removed from the copying machine, when maintenance such as repair or exchange of the drum is required. Further, the transmission shaft 122 and the second axial end portion 59C are supported by the pivot bearings such that the tapered portions are brought into contact with the pivot bearings. Hence, when the drum is assembled into the copying machine after the maintenance, it can be supported by the bearings without play. Furthermore, the transmission shaft 122 and the axial end portion 59C themselves serve as inner rings of the pivot bearings 123 and 114. Therefore, even when the drum 1C is inserted to or removed from the bearings, the performance of the bearings is not reduced by force in the axial direction of the drum, which is applied to the bearings. In FIGS. 5 and 6, the arrow B indicates the direction in which the drum 1C is inserted or removed.

When both axial end portions of the photoconductive drum are supported by radial bearings, as in the convention machine, it is necessary to provide a gap as a dimension tolerance between each axial end portion and bearing, in order to allow the axial end portions of the drum to be inserted into or removed from the bearings. The gap causes play of the drum. In addition, since the performance of the radial bearings is reduced by force in the axial direction of the drum, the photoconductive drum may vibrate or the rotational speed of the drum may change, in which case the obtained image may be disturbed.

A step of mounting the drum units 100Y, 100M, 100C and 100BK between the first and second body frames 51 and 50 will now be described.

Figure 9:
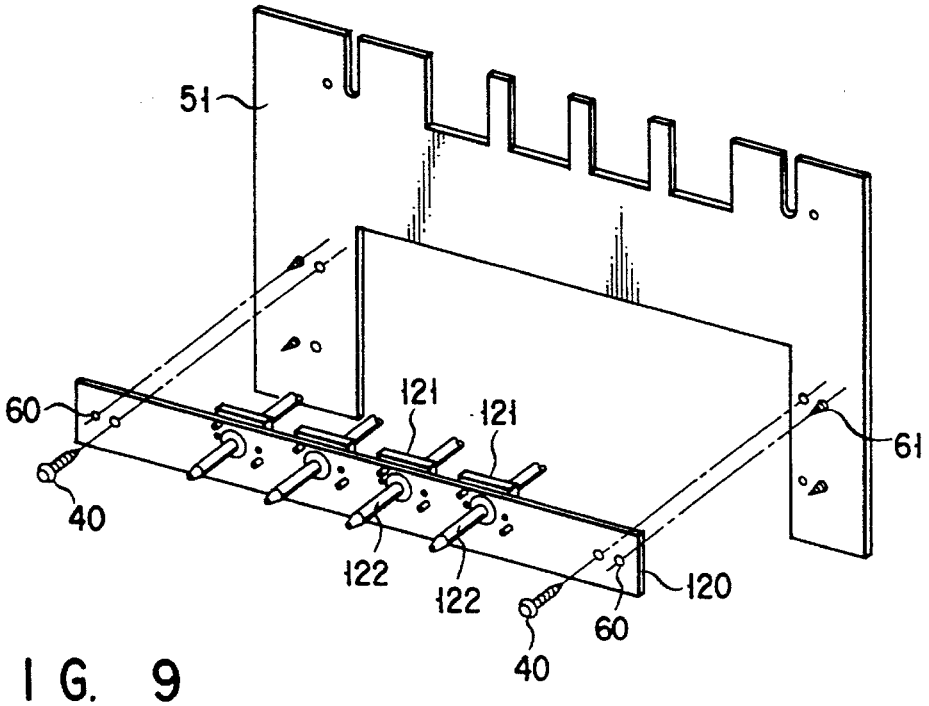

First, as shown in FIG. 9, the first supporting portions 121 for the drum units for the four colors, each having the first supporting member 124, the first pivot bearing 123 and the transmission shaft 122, are fixed to the first supporting plate 120 by means of the pairs of screws 30. At this time, the four supporting portions 121 are fixed accurately to predetermined portions of the supporting plate. The second supporting portions 113 of the drum units for the four colors, each having the second supporting member 112 and the second pivot bearing 114, are provisionally fixed via the holding members 111 to the second supporting plate 110 by means the pairs of screws 30. In this state, the second supporting members 112 are position-adjustable in directions parallel to the second supporting plate 110.

Figure 8:
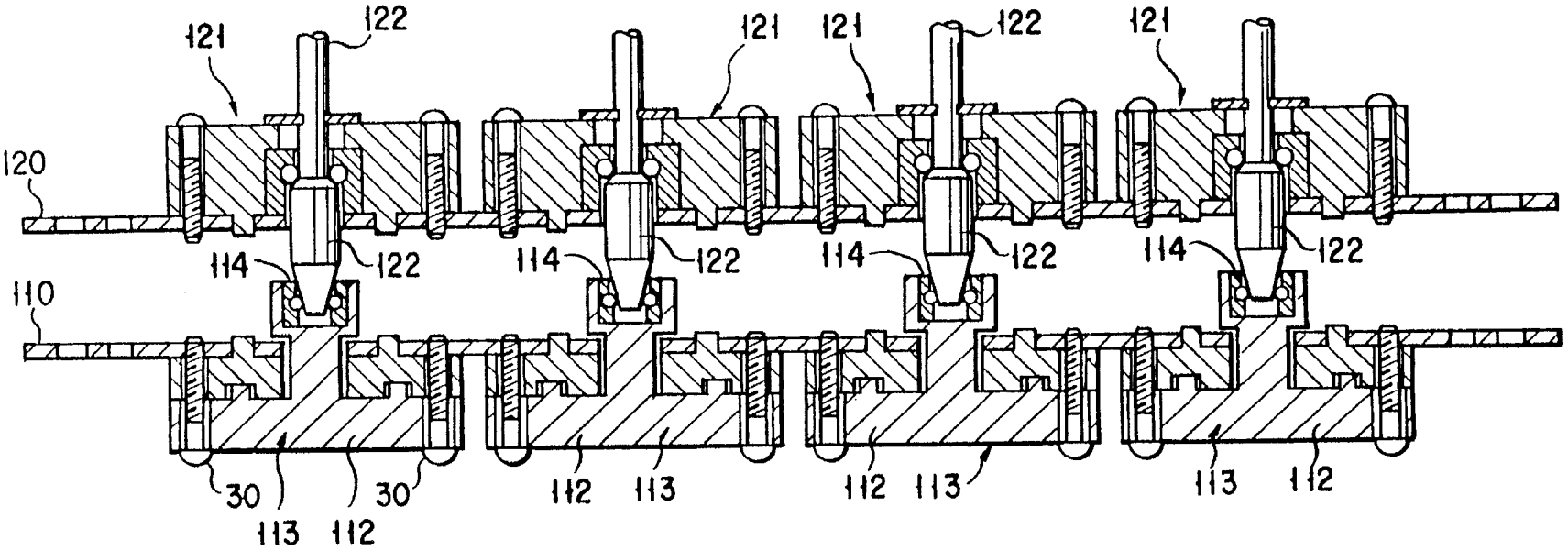

Subsequently, as shown in FIG. 8, the first supporting plate 120 and the second supporting plate 110 are placed opposite to each other. The pivot bearings 114 of the second supporting members 112, provisionally fixed to the second supporting plate 110, are respectively engaged with the free ends 122*a* of the transmission shafts 122. As a result, each of the second pivot bearings 114 is automatically moved to a position, in which the bearing 114 and the second supporting member 112 are aligned with the transmission shaft 122, since the free end 122*a* is tapered. Consequently, the second pivot bearings 114 of the four second supporting portions 113 of the second supporting plate 110 are adjusted to the positions corresponding to the four transfer shafts 122 of the first supporting plate 120. In this state, the screws 30 are fastened tight, so that the second supporting members 112 are immovably fixed to the second supporting plate 110. Through the steps as described above, the first and second supporting portions 121 and 113 can be set to predetermined positions, before they are assembled in the printer.

Thereafter, as shown in FIG. 9, the first supporting plate 120, to which the four supporting portions 121 are attached, is fixed to the first body frame 51. At this time, positioning pins 61 projecting from the body frame 51 are fitted in positioning holes 60 formed in longitudinal end portions of the first supporting plate 120, thereby positioning the first supporting plate to the body frame. Then, the first supporting plate 120 is fixed to the body frame 51 by a pair of screws 40.

Figure 10:
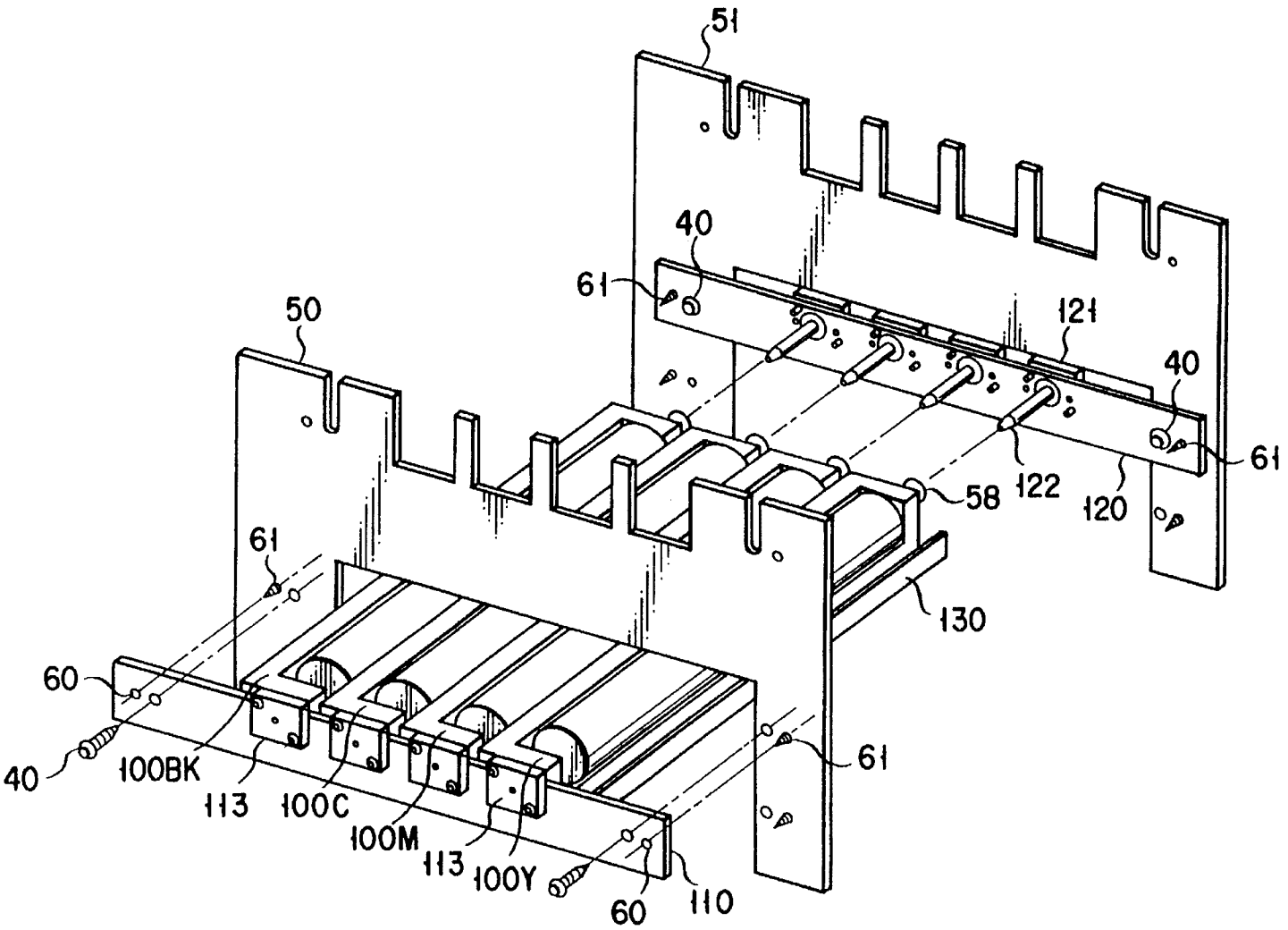

Subsequently, as shown in FIG. 10, a table 130, on which the drum units 100Y, 100M, 100C and 100BK are mounted, is inserted between the first and second body frames 51 and 50 from the front side of the housing by means of guide inserting means (not shown), so that the free ends 122*a* of the transmission shafts 122 are fitted in the recesses 57Y, 57M, 57C and 57BK formed in the first axial end portions 58Y, 58M, 58C and 58BK of the photoconductive drums 1Y, 1M, 1C and 1BK. Thereafter, the second pivot bearings 114 of the four second supporting portions 113 fixed to the second supporting plate 110 are engaged with the free ends 56Y, 56M, 56C and 56BK of the second axial end portions 59Y, 59M, 59C and 59BK of the corresponding photoconductive drums this state, positioning pins 61 projecting from the second body frame 50 are engaged with positioning holes 60 formed in both end portions of the second supporting plate 110, thereby positioning the second supporting plate 110 to the second body frame 50, and the second supporting plate is fixed to the second body frame by a pair of screws 40. The first and second supporting plates 120 and 110 have the same shape, since they have been formed in one process in a state where they are superposed one on the other. Therefore, even when they are fixed to the body frames 50 and 51, the relative position of the first and second supporting plates is not changed.

Figure 3:
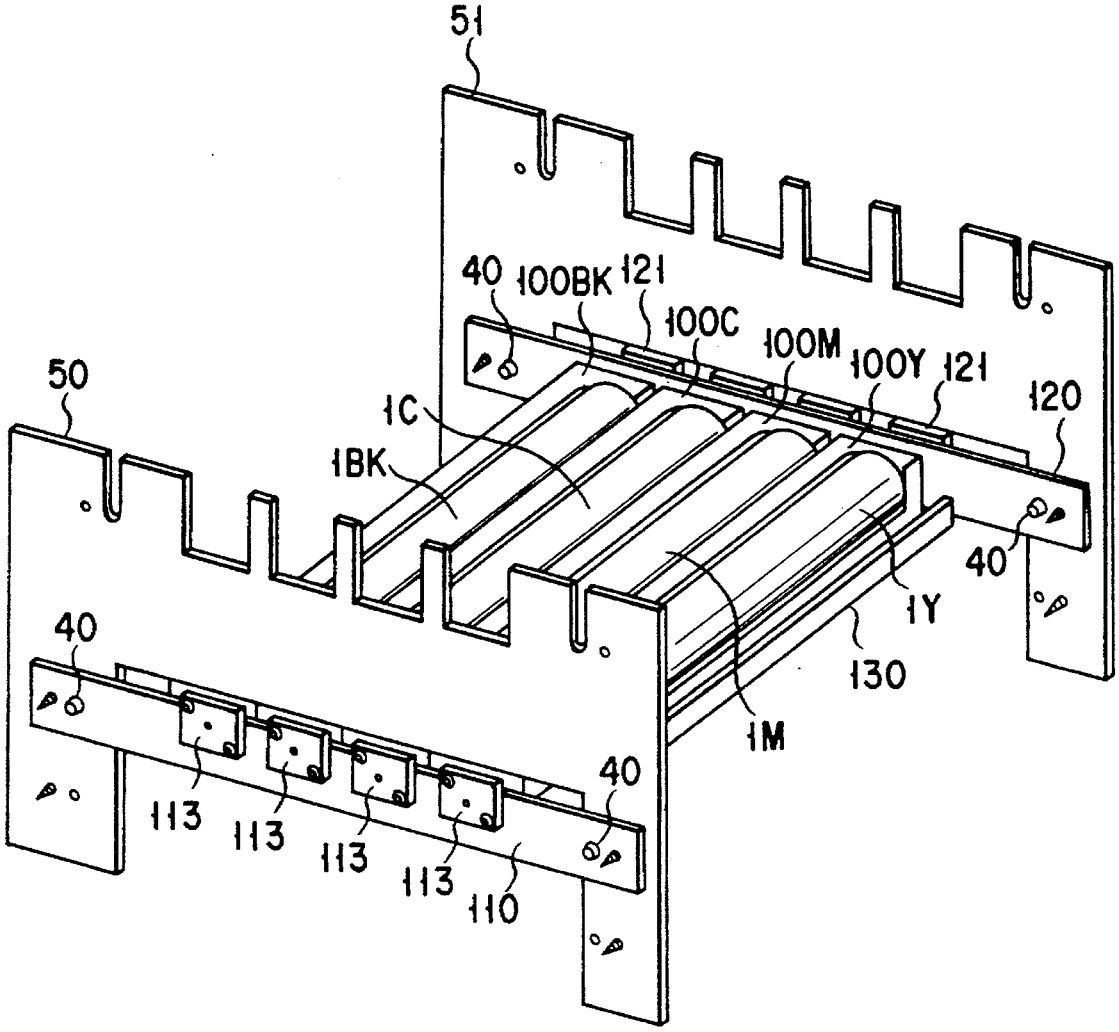
Figure 4:
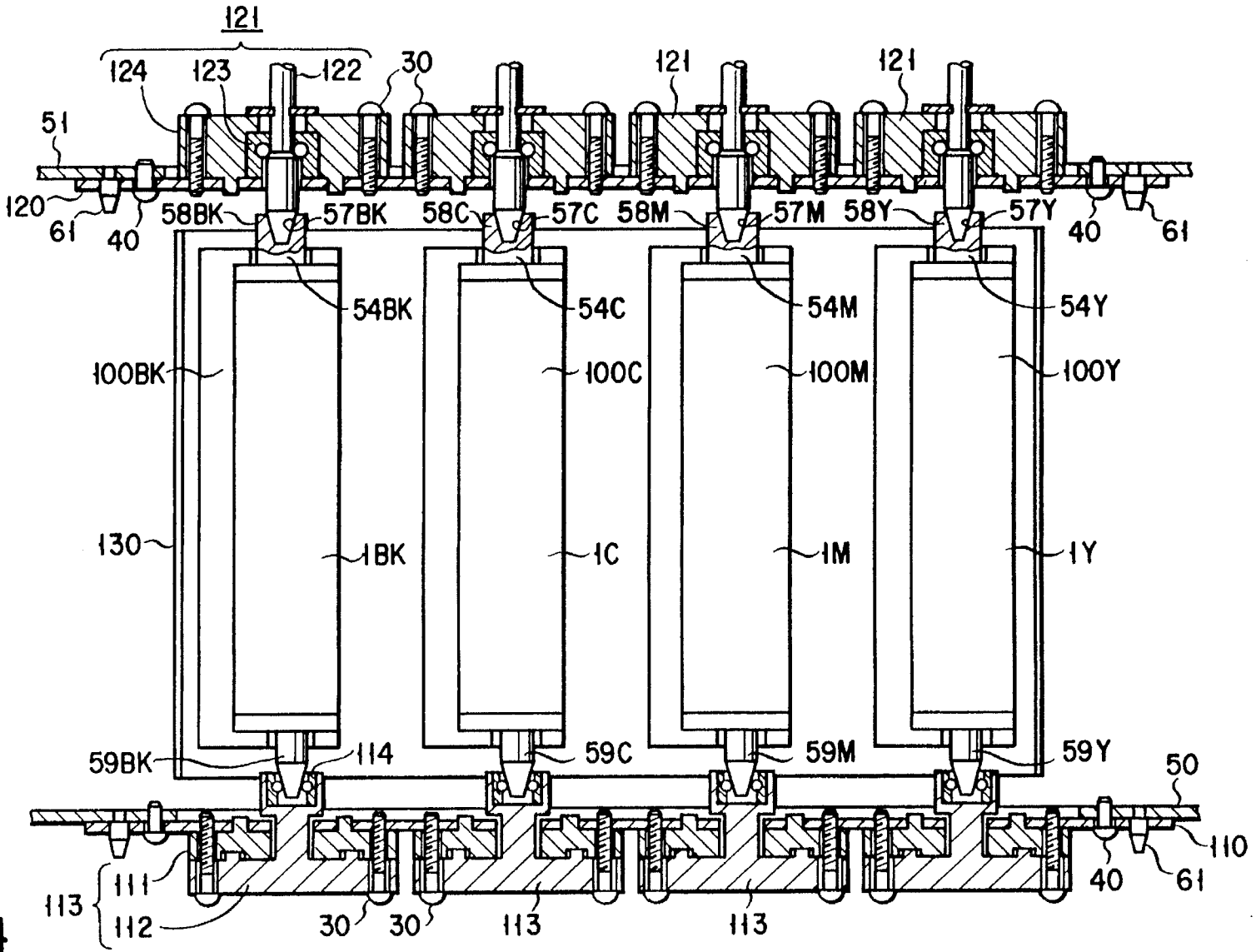

Through the steps as described above, the attachment of the drum units to the first and second body frames 50 and 51 is completed, as shown in FIGS. 3 and 4.

Mechanisms of supporting the exposing devices 5Y, 5M, 5C and 5BK will be described, referring to the exposing device 5C as a representative.

As shown in FIGS. 11 to 14, the exposing device 5C such as a solid scanning head extends between the first and second body frames 51 and 50. It comprises a first axial end portion 42C located in proximity to the first body frame and a second axial end portion 43C located in proximity to the second body frame. A tapered pin 65C projects from the end surface of the first axial end portion 42C and a tapered recess 66C, having the same shape as that of the pin 65C, is formed in the end face of the second axial end portion 43C. The first and second axial end portions 42C and 43C are respectively supported by the first and second body frames 51 and 50 via first and second supporting mechanisms serving as first and second supporting means.

The first supporting mechanism comprises a first elongated supporting plate 150 fixed to the first body frame 51 and four first supporting members 151 fixed to the first supporting plate. The first supporting members 151 are provided for the four colors, and fixed to the first supporting plate 150 at predetermined intervals in a horizontal direction. The first supporting members 151 are rectangular parallelepipeds and each of them has a pair of projections 151*a* engaged with holes formed in the first supporting plate 150, and a pair of through holes 151*b*. A pair of screws 30 inserted through the through holes 151*b* are screwed into the first supporting plate 150, thereby fixing the supporting member 151 to a predetermined position of the first supporting plate.

The first supporting member 151 has a tapered positioning hole 152, with which the pin 65C projected from the first axial end portion 42C is engaged. A screw 31 is screwed into the axial end portion 42C through a through hole 151C formed in the first supporting member 151, thereby fixing the axial end portion 42C to the first supporting plate 150.

The second supporting mechanism comprises a second elongated supporting plate 160 fixed to the second body frame 50 and four second supporting portions 161 fixed to the second supporting plate. The second supporting portions 161 are provided for the four colors and fixed to the second supporting plate 110 at predetermined intervals in a horizontal direction, so as to be aligned with the first supporting members 151. Each of the second supporting portions 161 comprises a rectangular parallelepiped second supporting member 163 and a holding member 162. The holding member 162 is arranged between the second supporting member 163 and the second supporting plate 160 and holds the second supporting member 163 such that the relative position of the member 163 and the plate 160 can be adjusted. The holding member 162 has a first contact surface in contact with the second supporting plate 160 and a second contact surface in contact with the second supporting member 163. These surfaces are flat and parallel to the supporting plate. The supporting member 162 has a pair of projections 44, projecting from the first contact surface and engaged with holes formed in the second supporting plate 160, and a pair of recesses 64 formed in the second contact surface.

The second supporting member 163 has a contact surface which is in surface-contact with the second contact surface of the holding member 162, a pair of projections 45 projecting from the contact surface and loosely engaged with the recesses, and a pair of through holes 46. A pair of screws 30 inserted through the through holes 46 are screwed into the second supporting plate 160, thereby fixing the second supporting member 163 to a predetermined position of the second supporting plate. The through hole 46 is sufficiently greater than the shaft portion of the screw 30. Therefore, when the screw 30 is loosened, the supporting member 163 can be moved in parallel with the second supporting plate 160.

A central portion of the second supporting member 163 projects toward the exposing device 5C and is inserted, with a gap, in through holes formed in the holding member 162 and the second supporting plate 160. The extended end of the central portion forms a tapered pin 48. The pin 48 has substantially the same shape as the pin 65C formed in the first axial end portion 42C of the exposing device 5C and can be engaged with the positioning hole 152 formed in the first supporting member 151 and the hole 66C formed in the second axial end portion 43C of the exposure device. The second axial end portion 43C is positioned with respect to the second supporting plate 160 by engaging the pin 48 with the hole 66C. The screw 31 is screwed into the axial end portion 43C through the second supporting member 163, the holding member 162 and the second supporting plate 160, thereby fixing the axial end portion 43C to the second supporting plate.

A step of mounting the exposing devices 5Y, 5M, 5C and 5BK between the first and second body frames 51 and 50 will now be described.

Figure 15:
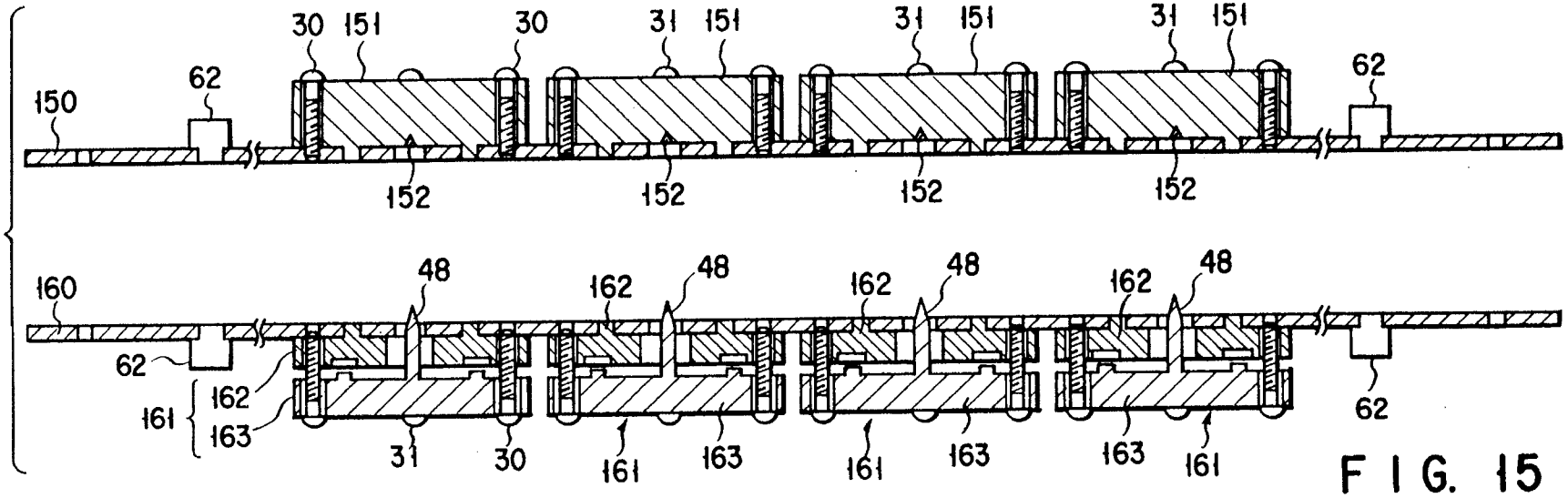

First, as shown in FIG. 15, the first supporting members 151 of the respective exposing devices are fixed to the first supporting plate 150 by the pairs of screws 30. At this time, the four supporting members 151 are fixed accurately to predetermined portions of the supporting plate. The second supporting members 163 corresponding to the four colors are provisionally fixed via the holding members 162 to the second supporting plate 160 by the pairs of screws 30. In this state, the second supporting members 163 are position-adjustable in a direction parallel to the second supporting plate 160, e.g., a direction in which the paper sheet is conveyed.

Figure 16:
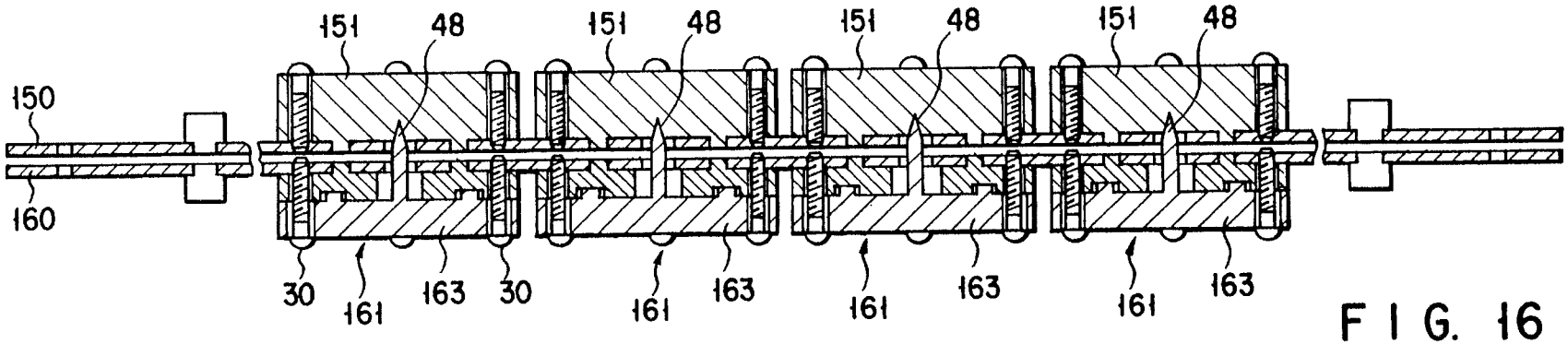

Subsequently, as shown in FIG. 16, the first supporting plate 150 and the second supporting plate 160 are placed opposite to each other in parallel, and the pins 48 of the second supporting members 163, provisionally fixed to the second supporting plate 160, are respectively engaged with the positioning holes 152 of the first supporting members 151. As a result, each of the pins 48 is automatically moved to a position, in which the pin 48 and the second supporting member 163 are aligned with the positioning hole 152, since the free end 122*a* are tapered. Consequently, the pins 48 of the second supporting members 163 on the second supporting plate 160 are adjusted to the positions corresponding to the positioning holes 152 of the four first supporting members 151 on the first supporting plate 150. In this state, the screws 30 are fastened tight, so that the second supporting members 163 are immovably fixed to the second supporting plate 160. Through the steps as described above, the first and second supporting members 151 and 163 can be set to predetermined positions, before they are attached to the housing of the printer.

Figure 13:
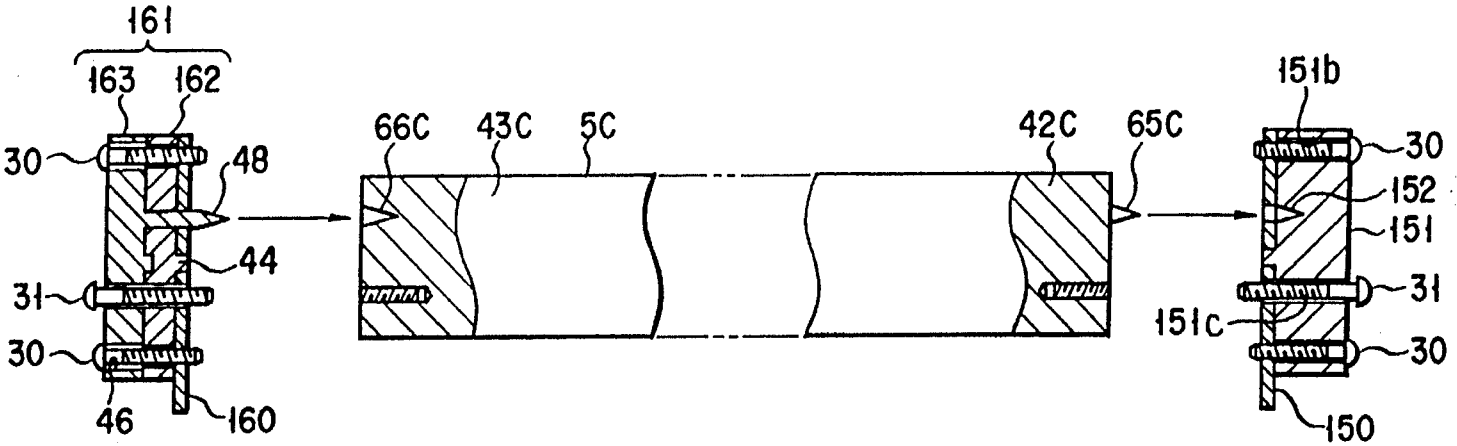
Figure 14:
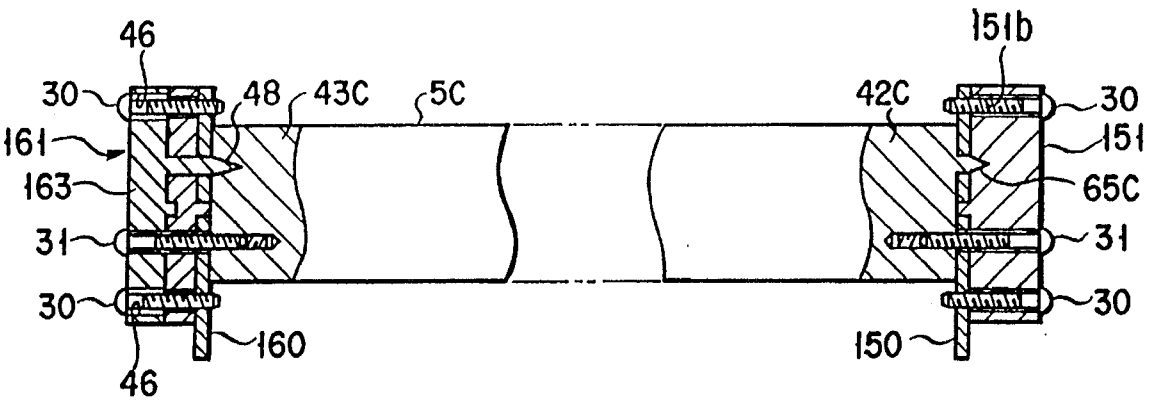

Next, as shown in FIGS. 13 and 14, the pin 65 of each of the exposing devices 5Y, 5M, 5C and 5BK is engaged with the positioning hole 152 of the corresponding first supporting member 151, and the pin 48 of the second supporting member 163 is engaged with the hole 66C of the corresponding exposure device, thereby positioning the exposure device with respect to the first and second supporting plates 150 and 160. Thereafter, the first and second axial end portions of the exposure devices are fixed to the first and second plates 150 and 160 by means of the screws 31, thus forming an exposing unit 131.

Figure 17:
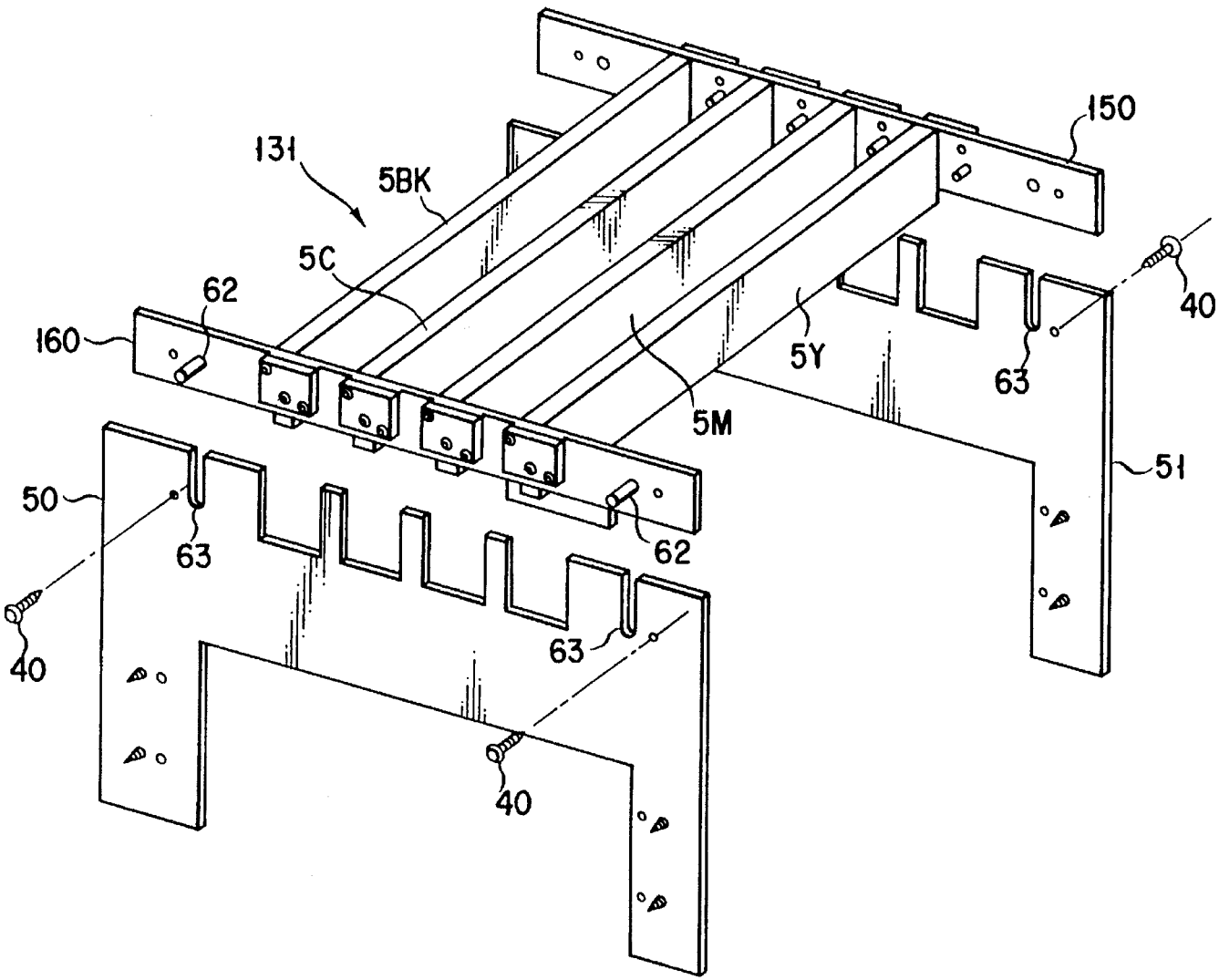

Then, as shown in FIG. 17, guide pins 62 projected from the end portions of the supporting plates 150 and 160 of the exposing unit 131 are inserted downward in guide slits 63 formed in the first and body frames 51 and 52, thereby positioning the exposing unit 131 with respect to the body frames. In this state, the first and second supporting plates 150 and 160 are respectively fixed to the first and second body frames by means of the screws 40. The first and second supporting plates 150 and 160 have the same shape, since they have been formed in one process in a state where they are superposed one on the other. Therefore, even when they are fixed to the body frames 50 and 51, the relative position of the first and second supporting plates is not changed.

Figure 11:
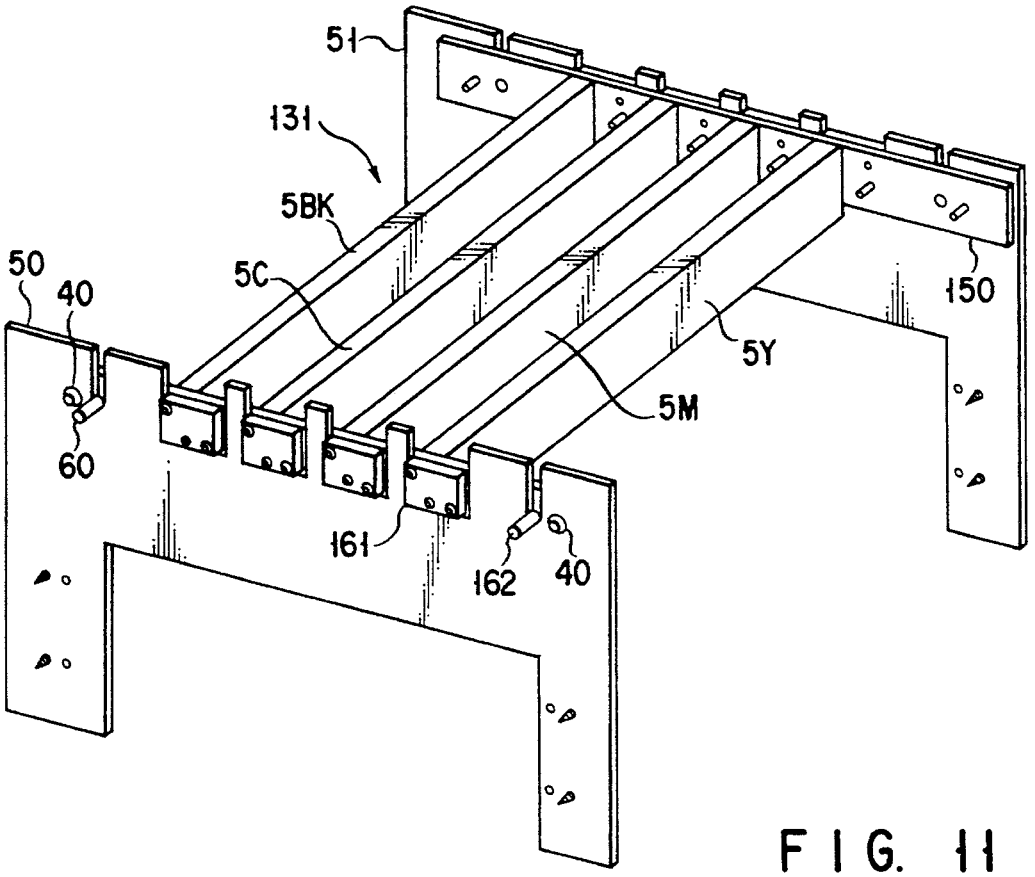
Figure 12:
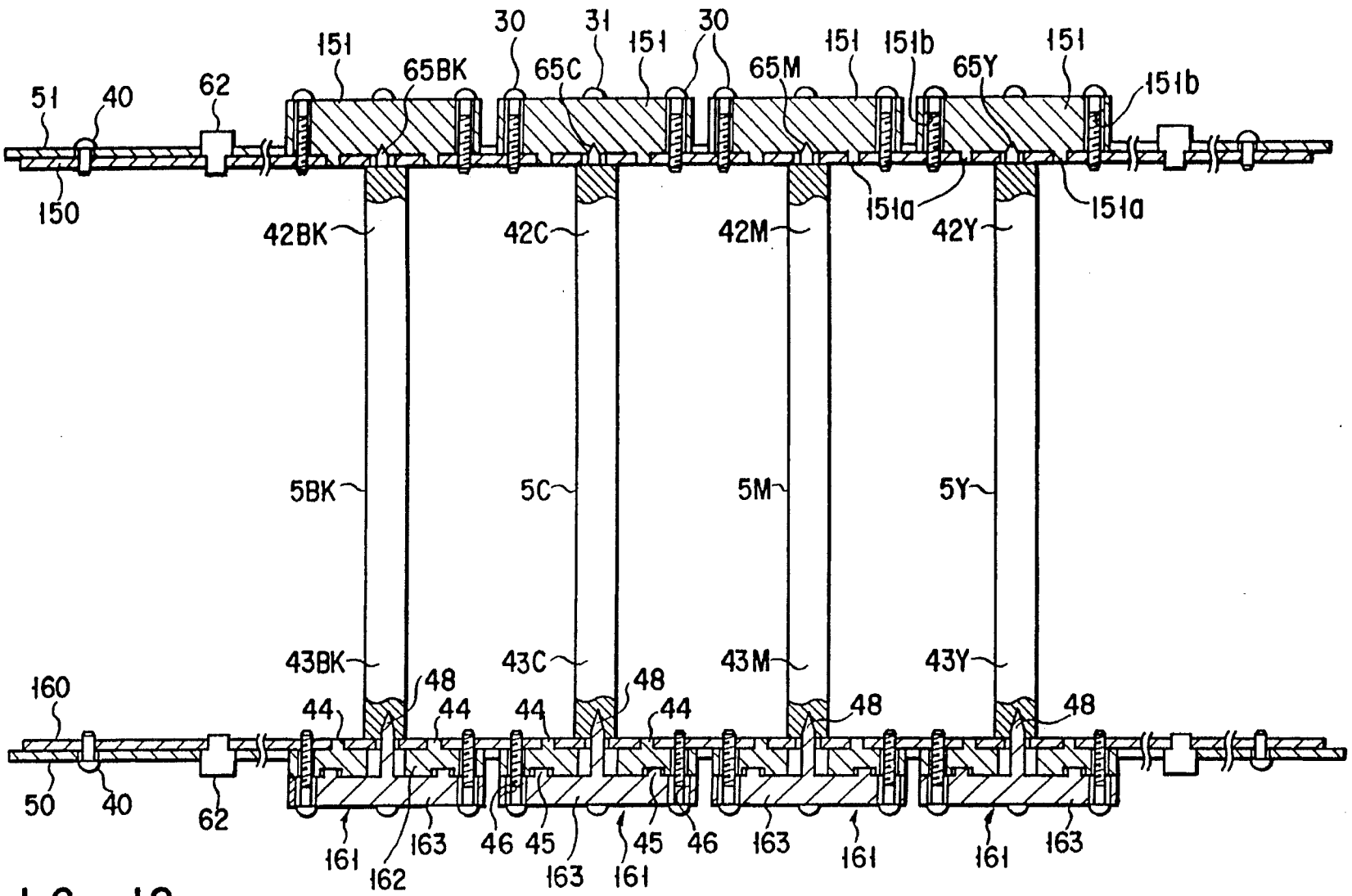

Through the steps as described above, the attachment of the exposing devices to the first and second body frames 50 and 51 is completed, as shown in FIGS. 11 and 12.

Next, supporting and attaching mechanisms of a transfer unit 199, which comprises a transfer material carrying belt 26 and transfer rollers 6Y 6M, 6C, 6BK, will be described.

Figure 18:
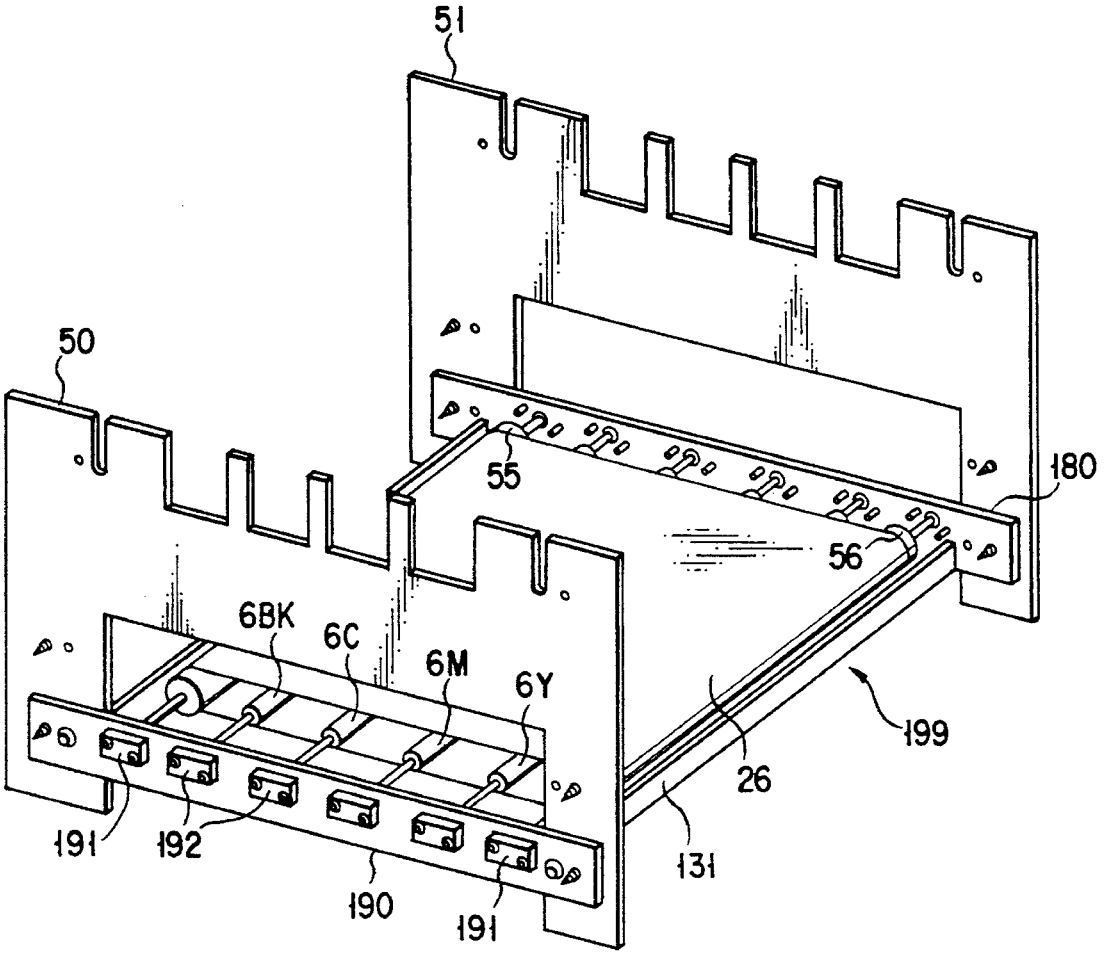
Figure 19:
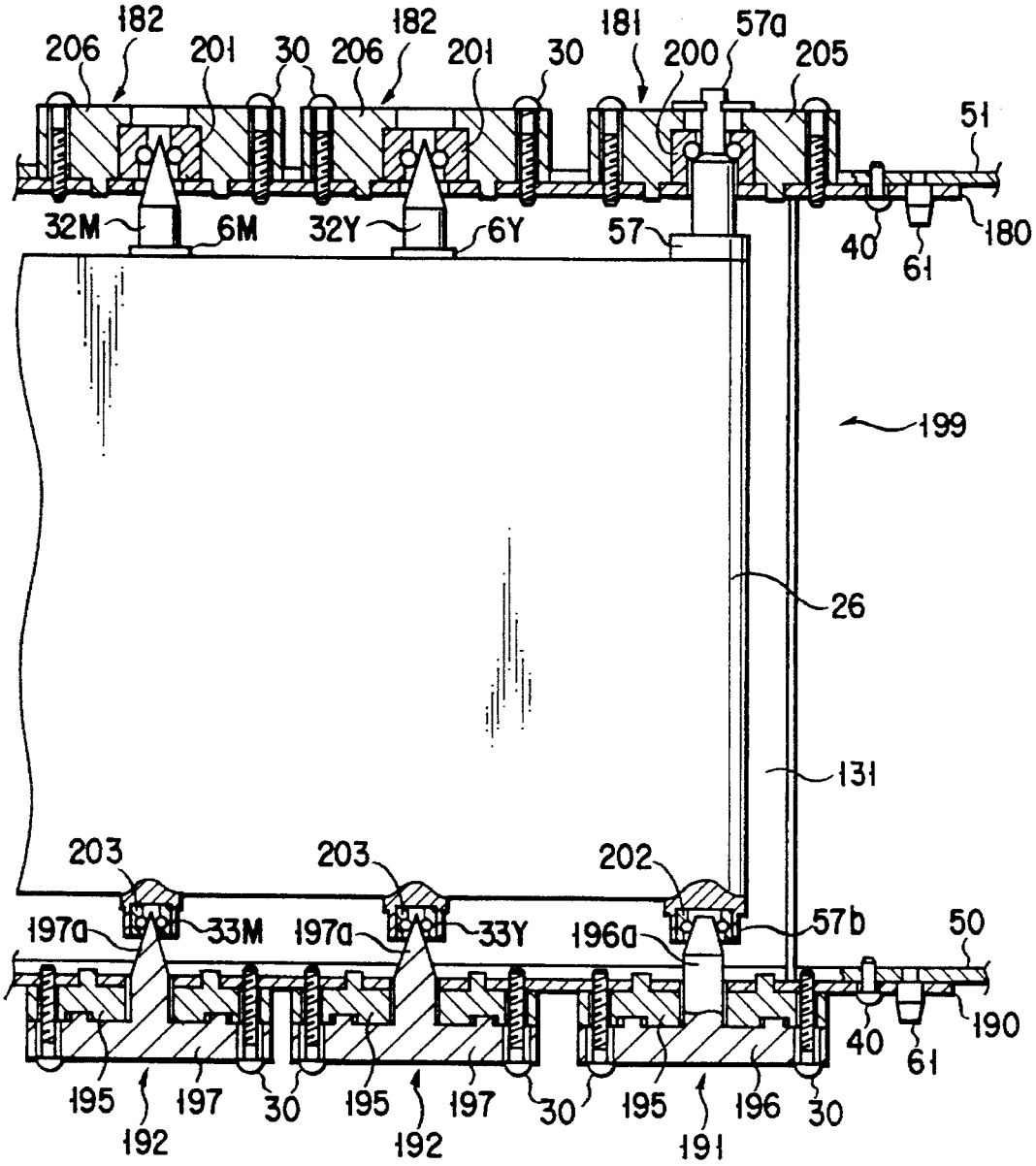
Figure 20:
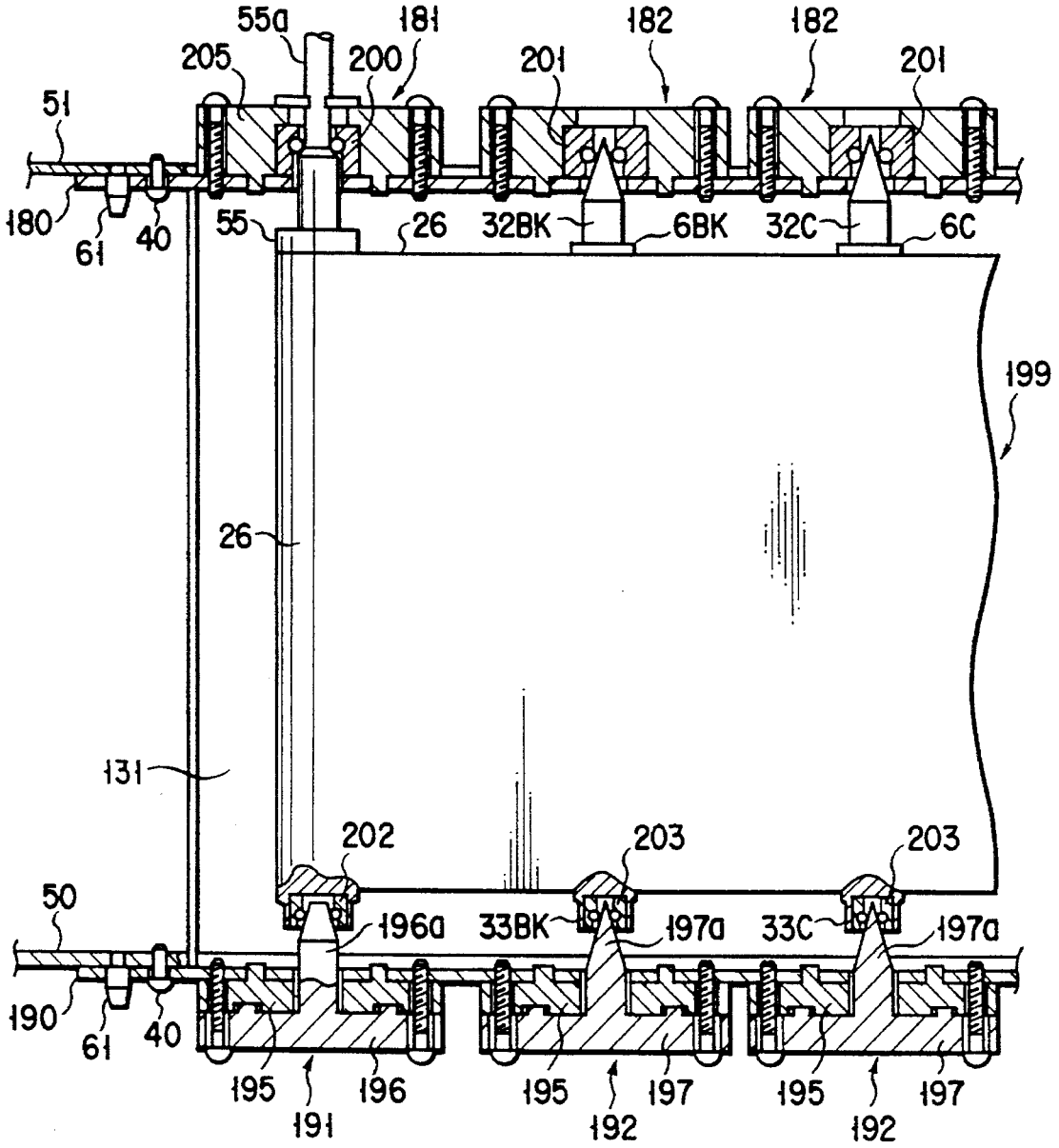

As shown in FIGS. 18 to 20, the transfer unit 199 comprises a driving roller 55 and a driven roller 56 which are spaced apart and parallel with each other; a transfer material carrying belt 26, stretched between these rollers, for carrying a transfer paper sheet P; transfer rollers 6Y, 6M, 6C and 6BK, provided between the driving and driven rollers, for transferring images to the paper sheet P at transferring positions of the recording devices; and first and second supporting plates 180 and 190 supporting these rollers.

A pair of first drive system supporting portions 181 and four first roller supporting portions 182 are fixed to the first supporting plate 180. The first drive system supporting portions 181 support first axial end portions 55*a* and 57*a* of the driving roller 55 and the driven roller 57. The first roller supporting portions 182 support first axial end portions 32Y, 32M, 32C and 32BK of the transfer rollers 6Y, 6M, 6C and 6BK. Each of the first drive system supporting portions 181 comprises a supporting member 205, fixed to the first supporting plate 180 by a pair of screws 30, and a first drive system pivot bearing 200 embedded in the supporting member. The first axial end portions 55*a* and 57*a* of the rollers 55 and 57 are rotatably supported by the pivot bearings 200 of the respective supporting portions 181. The first axial end portion 55*a* is connected to and rotated by a drive system (not shown) of the printer.

The first roller supporting portion 182 comprises a supporting member 206, fixed to the first supporting plate 180 by a pair of screws 30, and a first pivot bearing 201 embedded in the supporting member 206. A first axial end portion of each of the transfer rollers 6Y, 6M, 6C and 6BK is tapered and rotatably supported by the first pivot bearing 201 of the corresponding roller supporting portion. The pair of first drive system supporting portions 181 and the four first roller supporting portions 182 are arranged horizontally at regular intervals.

A pair of second drive system supporting portions 191 and four second roller supporting portions 192 are fixed to the second supporting plate 190. The second drive system supporting portions 191 support second axial end portions 55*b* and 57*b* of the driving roller 55 and the driven roller 57. The second roller supporting portions 192 support second axial end portions 33Y, 33M, 33C and 33BK of the transfer rollers 6Y, 6M, 6C and 6BK. The second drive system supporting portion 191 comprises a supporting member 196 fixed to the second supporting plate 190 by a pair of screws 30 and a holding member 195, provided between the second supporting plate and the supporting member 196, for holding the supporting member 196 so as to be movable in parallel with the supporting plate. Each of the supporting member 196 has a supporting shaft 196*a* projecting from its central portion and extending through the holding member 195 and the second supporting plate 190. An extended end of the supporting shaft 196*a* is tapered and engaged with the second drive system pivot bearing 202 embedded in the second axial end portion 55*b* or 57*b* of the driving or driven roller 55 or 57. The extended end of the supporting shaft 196*a* has such a shape as can be engaged with the first driving system pivot bearing 200.

The second supporting portion 192 comprises a supporting member 197, fixed to the second supporting plate 190 by a pair of screws 30, and a holding member 195, provided between the second supporting plate 190 and the supporting member 197, for holding the supporting member 197 so as to be movable in parallel with the supporting plate. The supporting member 197 has a supporting shaft 197*a* protruding from its central portion and extending through the holding member 195 and the second supporting plate 190. An extended end of the supporting shaft 197*a* is tapered and engaged with the second pivot bearing 203 embedded in the second axial end portion 33Y, 33M, 33C or 33BK of the transfer roller 6Y, 6M, 6C and 6BK. The extended end of the supporting shaft 197*a* has such a shape as can be engaged with the first pivot bearing 201. The pair of second drive system supporting portions 191 and the four second roller supporting portions 192 are respectively aligned with the first drive system supporting portions 181 and the four first roller supporting portions 182.

A step of assembling the aforementioned transfer unit 199 and attaching it between the first and second body frame 51 and 50 will be described below.

Figure 21:
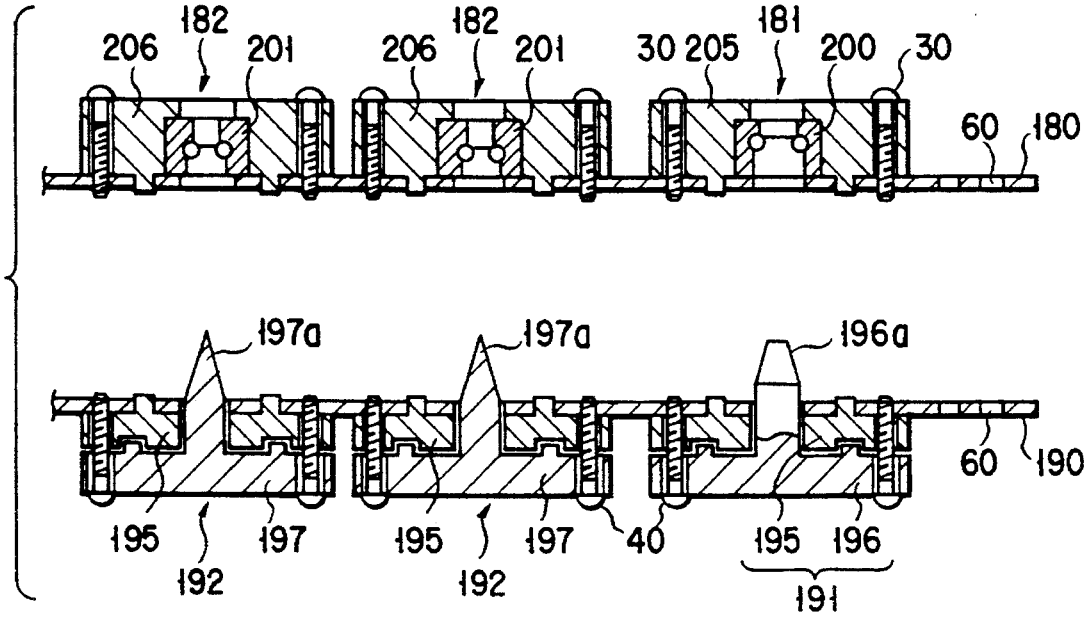
Figure 22:
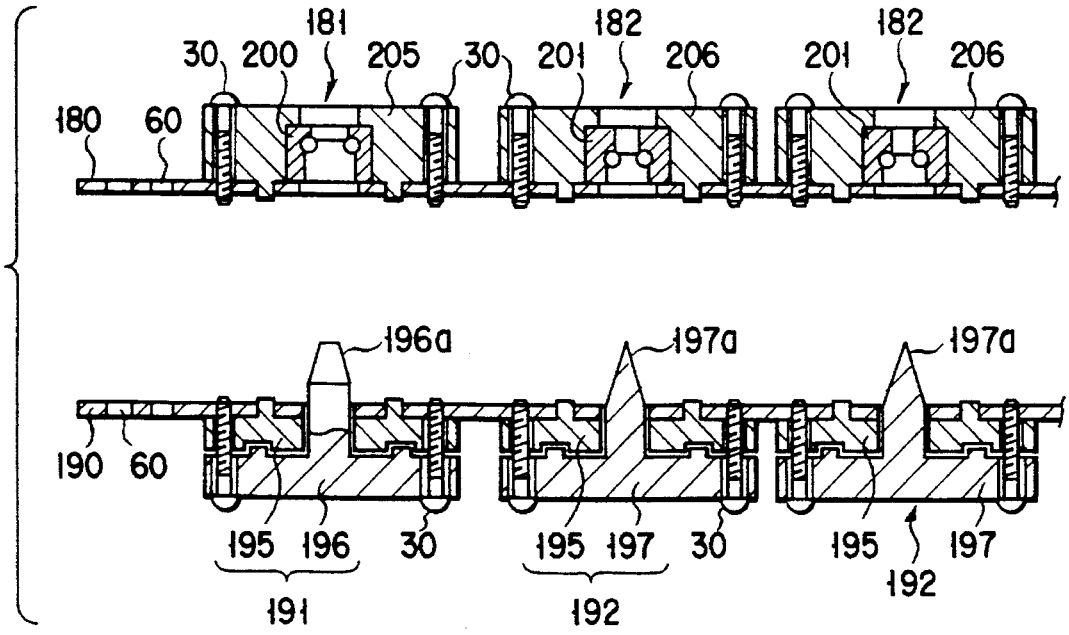

First, as shown in FIGS. 21 and 22, the first drive system supporting portions 181 and the first roller supporting portions 182 are fixed to predetermined portions of the first supporting plate 180 by the screws 30. The second drive system supporting portions 191 and the second roller supporting portions 192 are provisionally fixed to the second supporting plate 190, such that they are slidable in the direction in which the paper sheet is conveyed.

Figure 23:
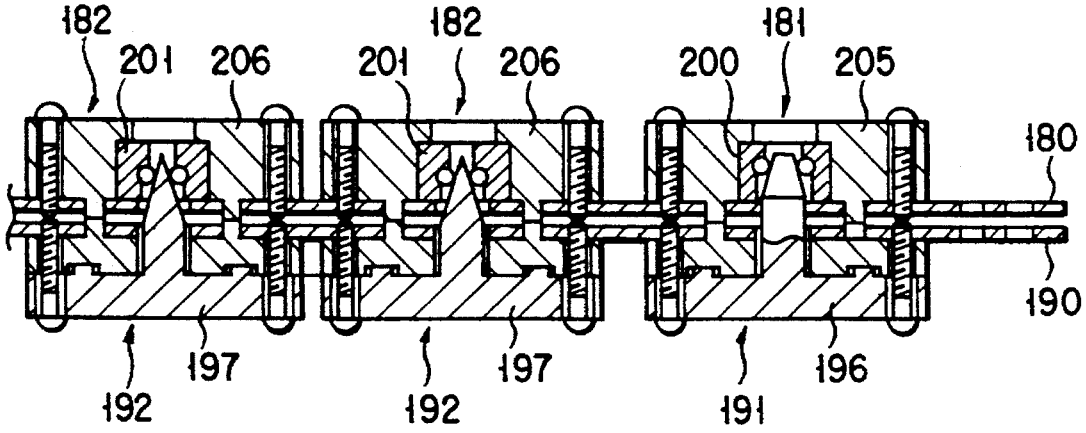
Figure 24:
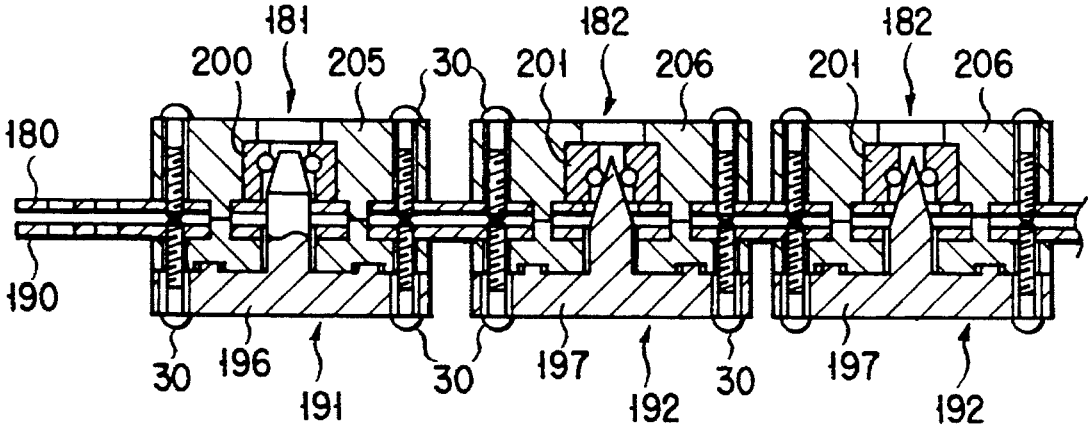

In this state, as shown in FIGS. 23 and 24, the first and second supporting plates 180 and 190 are placed opposite to each other, so that the supporting shafts 196*a* of the second drive system supporting portions and the supporting shafts 197*a* of the second roller supporting portions are respectively engaged with the first drive system pivot bearings 200 and the first pivot bearings 201. As a result, the pivot bearings 200 and 201 on the first supporting plate 180 are automatically position-adjusted and aligned with the supporting shafts 196*a* and 197*a* on the second supporting plate 190. The second supporting members 196 and 197 are then fixed tight to the second supporting plate 190 by the screws 30, so that the supporting shafts 196*a* and 197*a* may not move.

Figure 25:
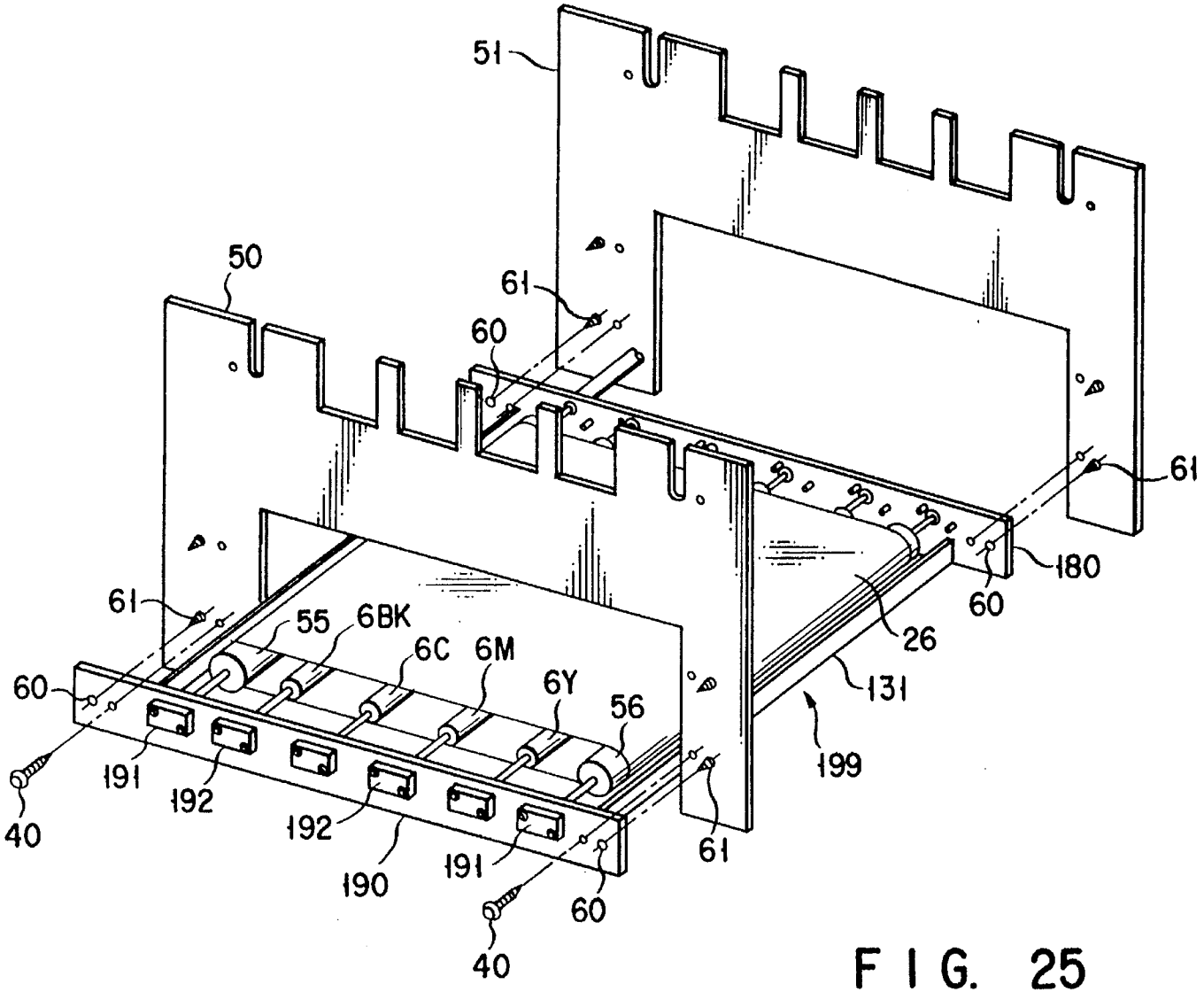

Thereafter, as shown in FIG. 25, the first axial end portions of the driving roller 55, the driven roller 57 and the four transfer rollers 6Y, 6M, 6C and 6BK are respectively engaged with the first pivot bearings 200 and 201 provided on the first supporting plate 180, and the supporting shafts 196*a* and 197*a* on the second supporting plate 190 are respectively engaged with the second pivot bearings 202, 203 provided on the second axial end portions of the driving roller 55, the driven roller 57 and the four transfer rollers. Thus, the transfer unit 199 is assembled. Subsequently, the table 131, on which the transfer unit 199 is mounted, is inserted between the first and second body frames 51 and 50 by guide inserting means (not shown) from the front side of the printer. The positioning pins 61 of the first body frame 51 are engaged with the positioning holes 60 formed on both sides of the first supporting plate 180, thereby positioning the first supporting plate 180 with respect to the first body frame 51. The positioning pins 61 of the second body frame 50 are engaged with the positioning holes 60 formed on both sides of the second supporting plate 190, thereby positioning the second supporting plate 190 with respect to the second body frame 50. Then, the first and second supporting plates are fixed to the first and second body frames by screws 40.

In the manner as described above, the transfer unit 199 is fixed to the body frames 50 and 51, as shown in FIGS. 18 to 20.

The first and second supporting plates 180 and 190 have the same shape, since they have been formed in one process in a state where they are superposed one on the other. Therefore, even when they are fixed to the body frames 50 and 51, the relative position of the first and second supporting plates is not changed. In the above structure, the body frames, to which the first supporting plates 120, 150 and 180 and the second supporting plates 110, 160 and 190 for supporting the components are fixed, have the same shape, since they have been formed in one process in a state where they are superposed one on the other.

According to the color printer thus constructed, the first and second supporting portions of the supporting mechanism for supporting the components are positioned and fixed to each other so as to be aligned with each other, before they are fixed to the body frames. Therefore, the components, such as the photoconductive drums 1Y, 1M, 1C and 1BK, the exposing devices 5Y, 5M, 5C and 5BK, the transfer rollers 6Y, 6M, 6C and 6BK, and the driving roller 55 and the driven roller 57 for the transfer material conveying belt 16, are arranged parallel with one another with a high accuracy, without adjusting the relative position of the components after the color printer is assembled. As a result, a satisfactory image, free from color deviation, can be formed. In addition, after the printer is assembled, it is unnecessary to adjust the positions of the components while operating the printer, so that the assembling efficiency can be greatly improved.

Moreover, the rotational members attached to the first and second supporting plates are all supported by the combination of the pivot bearings and the tapered supporting portions. Hence, even if any rotational member is fitted to the pivot bearing after being removed therefrom for maintenance, such as repair or exchange, a gap cannot be generated between the bearing and the supporting portion. Further, since the supporting portion serves as an inner ring of the bearing, the performance of the bearing is not reduced due to force applied to the axial direction of the bearing.

Furthermore, since the drum units, the exposing devices and the transfer units are constructed in units, it is possible to assemble, adjust and maintain (repair or exchange) every unit of the components.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An image forming apparatus for forming a color image comprising:

first image forming means for forming an image of a first color on a first image carrier which has a first rotational shaft;

second image forming means for forming an image of a second color on a second image carrier which has a second rotational shaft;

first and second supporting plates for supporting the first and second rotating shafts substantially in parallel to each other;

first and second supporting members attaching the first and second rotational shafts to the first supporting plate, the first supporting member having a first driving force transmission shaft for rotating the first rotational shaft, a first pivot bearing member for rotatably supporting the first driving force transmission shaft, and a first fixing portion for fixing the first supporting member to the first supporting plate, and the second supporting member having a second driving force transmission shaft for rotating the second rotational shaft, a second pivot bearing member for rotatably supporting the second driving force transmission shaft, and a second fixing portion for fixing the second supporting member to the first supporting plate; and third and fourth supporting members attaching the first and second rotational shafts to the second supporting plate, the third supporting member having a third pivot bearing member for rotatably supporting the first rotational shaft of the first image carrier, and a third fixing portion for fixing the third supporting member to the second supporting plate, and the fourth supporting member having a fourth pivot bearing member for rotatably supporting the second rotational shaft of the second image carrier, and a fourth fixing portion for fixing the fourth supporting member to the second supporting plate.

2. An image forming apparatus according to claim 1, wherein said first rotational shaft includes a tapered axial end portion engaging the third pivot bearing member; the second rotational shaft includes a tapered axial end portion engaging the fourth pivot bearing member;

the first driving force transmission shaft includes a tapered portion engaging the first pivot bearing; and the second driving force transmission shaft includes a tapered portion engaging the second pivot bearing.

3. An image forming apparatus for forming a color image comprising:

a first solid scanning head for forming a first latent image on a first image carrier, the first solid scanning head including a first end portion which has a first tapered recess;

a second solid scanning head for forming a second latent image on a second image carrier, the second solid scanning head including a first end portion which has a second tapered projection, and a second end portion which has a second tapered recess;

first and second supporting plates for supporting the first and second solid scanning heads substantially in parallel to each other;

first and second supporting members attaching the first and second solid scanning heads to the first supporting plate, the first supporting member having a first tapered positioning portion for engaging the first tapered projection of the first solid scanning head, and a first fixing portion for fixing the first supporting member to the first supporting plate, and the second supporting member having a second tapered positioning portion for engaging the second tapered projection of the second solid scanning head, and a second fixing portion for fixing the second supporting member to the first supporting plate; and third and fourth supporting members attaching the first and second solid scanning heads to the second supporting plate, the third supporting member having a first tapered positioning pin member for engaging the first tapered recess of the first slid scanning head, and a third fixing portion for supporting the third supporting member on the second supporting plate to be movable so that the first positioning pin member is aligned with the first tapered recess, and the fourth supporting member having a second tapered positioning pin member for engaging the second tapered recess of the second solid scanning head, and a fourth fixing portion for supporting the fourth supporting member to the second supporting plate to be movable so that the second positioning pin member is aligned with the second tapered recess.

4. An image forming apparatus according to claim 3, wherein said first and second positioning portions of the first and second supporting members have a shape engageable with the first and second positioning pin members of the third and fourth supporting members, respectively.

5. An image forming apparatus according to claim 3, wherein said first fixing portion comprises a first holding member which is arranged between the first supporting plate and the first supporting member and slidable with respect to the first supporting member, a through hole formed in the first supporting member, and a screw loosely inserted in the through hole and screwed into the first supporting plate through the first holding member; and said second fixing portion comprises a second holding member which is arranged between the first supporting plate and the second supporting member and slidable with respect to the second supporting member, a through hole formed in the second supporting member, and a screw loosely inserted in the through hole and screwed into the first supporting plate through the second holding member.

6. An image forming apparatus according to claim 3, wherein said third fixing portion comprises a third holding member which is arranged between the second supporting plate and the third supporting member and slidable with respect to the third supporting member, a through hole formed in the third supporting member, and a screw loosely inserted in the through hole and screwed into the second supporting plate through the third holding member; and said fourth fixing portion comprises a fourth holding member which is arranged between the second supporting plate and the fourth supporting member and slidable with respect to the third supporting member, a through hole formed in the fourth supporting member, and a screw loosely inserted in the through hole and screwed into the second supporting plate through the fourth holding member.

7. An image forming apparatus for forming a color image comprising:

a first transfer roller for transferring an image of a first color formed on a first image carrier to a transfer material, the first transfer roller including a first axial end portion having a tapered projection, and a second axial end portion having a first pivot bearing member;

a second transfer roller for transferring an image of a second color formed on a second image carrier to the transfer material, the second transfer roller including a first axial end portion having a tapered projection, and a second axial end portion having a second pivot bearing member;

first and second supporting plates supporting the first and second transfer roller substantially in parallel to each other;

first and second supporting members attaching the first and second transfer rollers to the first supporting plate, the first supporting member including a third pivot bearing member to which the first tapered projection of the first transfer roller is fitted, and a first fixing portion for fixing the first supporting member to the first supporting plate, and the second supporting member including a fourth pivot bearing member to which the second tapered projection of the second transfer roller is fitted, and a second fixing portion fixing the second supporting member to the first supporting plate; and third and fourth supporting members attaching the first and second transfer rollers to the second supporting plate, the third supporting member having a first tapered positioning pin member for engaging the first pivot bearing member of the first transfer roller, and a third fixing portion for supporting the third supporting member on the second supporting plate to be movable so that the first positioning pin member is aligned with the first pivot bearing member, and the fourth supporting member having a second tapered positioning pin member for engaging the second pivot bearing member of the second transfer roller, and a fourth fixing portion for supporting the fourth supporting member to the second supporting plate to be movable so that the second positioning pin member is aligned with the second pivot bearing member.

8. An image forming apparatus according to claim 7, wherein said first fixing portion comprises a first holding member which is arranged between the first supporting plate and the first supporting member and slidable with respect to the first supporting member, a through hole formed in the first supporting member, and a screw loosely inserted in the through hole and screwed into the first supporting plate through the first holding member; and said second fixing portion comprises a second holding member which is arranged between the first supporting plate and the second supporting member and slidable with respect to the second supporting member, a through hole formed in the second supporting member, and a screw loosely inserted in the through hole and screwed into the first supporting plate through the second holding member.

9. An image forming apparatus according to claim 6, wherein said third fixing portion comprises a third holding member which is arranged between the second supporting plate and the third supporting member and slidable with respect to the third supporting member, a through hole formed in the third supporting member, and a screw loosely inserted in the through hole and screwed into the second supporting plate through the third holding member; and said fourth fixing portion comprises a fourth holding member which is arranged between the second supporting plate and the fourth supporting member and slidable with respect to the third supporting member, a through hole formed in the fourth supporting member, and a screw loosely inserted in the through hole and screwed into the second supporting plate through the fourth holding member.

10. An image forming apparatus according to claim 7, which further comprises:

a conveying belt for conveying the transfer material;

supporting means for supporting the conveying belt, the supporting means having driving roller and driven roller for driving the conveying belt, the driving roller including a first end portion having a first projection, and a second end portion having a fifth pivot bearing member, the driven roller a first end portion having a second projection, and a second end portion having a sixth pivot bearing member;

fifth and sixth supporting members attaching the driving and driven rollers to the first supporting plate, the fifth supporting member including a seventh pivot bearing member to which the first projection of driving roller is fitted, and the sixth supporting member including a eighth pivot bearing member to which the second projection of the driven roller is fitted;

seventh and eighth supporting members attaching the driving and driven rollers to the second supporting plate, the seventh supporting member having a third tapered positioning pin member for engaging the fifth pivot bearing member of the driving roller, and the eighth supporting member having a fourth tapered positioning pin member for engaging the sixth pivot bearing member of the driven roller.

11. An image forming apparatus for forming a color image comprising:

first image forming means for forming an image of a first color on a first image carrier which has a first rotational shaft, the first rotational shaft including a first axial end portion having a tapered recess, and a second axial end portion which is tapered;

second image forming means for forming an image of a second color on a second image carrier which has a second rotational shaft, the second rotational shaft including a third axial end portion having a tapered recess, and a fourth axial end portion which is tapered;

first and second supporting plates for supporting the first and second rotating shafts substantially in parallel to each other;

first and second supporting members attaching the first and second rotational shafts to the first supporting plate, the first supporting member including a first driving force transmission shaft having a tapered axial end which engages with the tapered recess of the first axial end portion, for rotating the first rotational shaft, a first pivot bearing member for rotatably supporting the first driving force transmission shaft, and a first fixing portion for fixing the first supporting member to the first supporting plate, and the second supporting member including a second driving force transmission shaft having a tapered axial end which engages with the tapered recess of the third axial end portion, for rotating the second rotational shaft, a second pivot bearing member for rotatably supporting the second driving force transmission shaft, and a second fixing portion for fixing the second supporting member to the first supporting plate; and third and fourth supporting members attaching the first and second rotational shafts to the second supporting plate, the third supporting member including a third pivot bearing member for rotatably supporting the second axial end portion of the first rotational shaft, and a third fixing portion for fixing the third supporting member to the second supporting plate, and the fourth supporting member including a fourth pivot bearing member for rotatably supporting the fourth axial end portion of the second rotational shaft, and a fourth fixing portion for fixing the fourth supporting member to the second supporting plate.

12. An image forming apparatus according to claim 11, wherein the tapered axial end of the first driving force transmission shaft has a shape engageable with the third pivot bearing member, and the tapered axial end of the second driving force transmission shaft has a shape engageable with the fourth pivot bearing member.

13. The apparatus according to claim 11, wherein said third fixing portion comprises a holding member which is arranged between the second supporting plate and the third supporting member and slidable with respect to the third supporting member, a through hole formed in the third supporting member, and a screw loosely inserted in the through hole and screwed into the second supporting plate through the holding member; and said fourth fixing portion comprises a holding member which is arranged between the second supporting plate and the fourth supporting member and slidable with respect to the third supporting member, a through hole formed in the fourth supporting member, and a screw loosely inserted in the through hole and screwed into the second supporting plate through the holding member.

* * * * *